US010414537B2

(12) United States Patent
Imai et al.

(10) Patent No.: US 10,414,537 B2
(45) Date of Patent: Sep. 17, 2019

(54) PACKING BOX

(71) Applicant: FUJI XEROX CO., LTD., Tokyo (JP)

(72) Inventors: Seiya Imai, Yokohama (JP); Seiji Ogawa, Yokohama (JP); Keigo Yamada, Yokohama (JP); Yohei Suzuki, Yokohama (JP); Kenji Matsuura, Yokohama (JP); Shingo Aso, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 31 days.

(21) Appl. No.: 15/730,328

(22) Filed: Oct. 11, 2017

(65) Prior Publication Data

US 2018/0215499 A1 Aug. 2, 2018

(30) Foreign Application Priority Data

Feb. 1, 2017 (JP) ..... 2017-016391
Feb. 1, 2017 (JP) ..... 2017-016392

(51) Int. Cl.

| | |
|---|---|
| ***B65D 5/42*** | (2006.01) |
| ***B65D 5/50*** | (2006.01) |
| ***B65D 5/54*** | (2006.01) |
| ***B65D 5/36*** | (2006.01) |
| ***B65D 5/32*** | (2006.01) |

(52) U.S. Cl.

CPC ..... *B65D 5/42* (2013.01); *B65D 5/32* (2013.01); *B65D 5/36* (2013.01); *B65D 5/5004* (2013.01); *B65D 5/541* (2013.01)

(58) Field of Classification Search

CPC ... B65D 5/42; B65D 5/36; B65D 5/32; B65D 5/12; B65D 2543/00

USPC ..... 229/125.08, 125.01, 125.03, 125.19, 229/125.21

See application file for complete search history.

(56) References Cited

U.S. PATENT DOCUMENTS 1,352,759 A * 9/1920 Markert ..... B65D 5/5014 206/486
2,443,810 A * 6/1948 White ..... B65D 5/5069 206/422
2,531,090 A * 11/1950 Turner ..... B65D 5/5014 206/391
2,569,733 A * 10/1951 Ringler ..... B65D 5/5021 206/422
2,588,791 A * 3/1952 Andrew, Jr. ..... B65D 71/16 206/194
3,294,308 A * 12/1966 Tress ..... B65D 85/305 206/139

(Continued)

FOREIGN PATENT DOCUMENTS

JP 2010-083490 A 4/2010

*Primary Examiner* — Brian D Nash
(74) *Attorney, Agent, or Firm* — Oliff PLC

(57) ABSTRACT

An aspect of the invention is directed to a packing box in which at least part of an opening through which to insert and take out an object to be packed is closed by inside lids that are opposed to each other in a plane, wherein: the inside lids have a cut portion including a cut that is shaped so as to be suitable for the external shape of a portion of the object and folded portions formed by folding the respective inside lids, and, when the inside lids are closed, the cut is fitted with the portion of the object housed in the packing box to fix the object in a state that walls, opposed to each other, of the respective folded portions are in contact with each other.

16 Claims, 29 Drawing Sheets

(56) References Cited

U.S. PATENT DOCUMENTS 3,349,986 A * 10/1967 Chapman ..... B65D 5/76 206/588
3,361,324 A * 1/1968 Crisafulli ..... B65D 5/48016 229/120
3,493,164 A * 2/1970 Edwards ..... B65D 85/324 206/518
3,822,822 A * 7/1974 Arneson ..... B65D 71/36 206/139
3,827,550 A * 8/1974 Arneson ..... B65D 71/36 206/181
3,899,076 A * 8/1975 Florian ..... B65D 71/0003 206/199
4,088,262 A * 5/1978 Kuehlhorn ..... B65D 5/4608 206/194
4,174,051 A * 11/1979 Edwards ..... B65D 77/065 220/288
4,314,639 A * 2/1982 Gloyer ..... B65D 5/46088 206/141
4,582,198 A * 4/1986 Ditton ..... B65D 5/443 206/389
4,832,199 A * 5/1989 Rigby ..... B65D 5/5021 206/485
4,927,042 A * 5/1990 Ring ..... B65D 21/0237 206/431
5,284,242 A * 2/1994 Roth ..... G11B 33/02 206/309
5,328,027 A * 7/1994 Hollar ..... B65D 5/18 206/320
5,385,232 A * 1/1995 Foos ..... B65D 81/025 206/320
5,462,171 A * 10/1995 Moog ..... B65D 81/113 206/588
5,505,309 A * 4/1996 Taravella ..... B65D 5/5021 206/485
5,996,804 A * 12/1999 Kuhn ..... B65D 5/5014 206/193
6,102,204 A * 8/2000 Castleberry ..... B65D 5/503 206/423
6,149,002 A * 11/2000 Tiramani ..... B65D 81/052 206/320
6,959,813 B2 * 11/2005 Colby ..... B65D 5/0227 206/526
8,181,787 B2 * 5/2012 Klos ..... B65D 5/5213 206/462
8,329,268 B2 * 12/2012 Bell ..... A01G 9/02 229/119
2003/0217948 A1 * 11/2003 Lantz ..... B65D 5/48038 206/591
2005/0045496 A1 * 3/2005 Jenkins ..... B65D 5/3621 206/45.25
2008/0257944 A1 * 10/2008 Blin ..... B65D 71/38 229/125.19
2009/0045248 A1 * 2/2009 Grigsby ..... B65D 5/0227 229/185
2009/0173773 A1 * 7/2009 Blin ..... B65D 5/443 229/117.16
2013/0206828 A1 * 8/2013 Schomisch ..... B65D 5/32 229/122
2014/0021080 A1 * 1/2014 Fitzwater ..... B65B 5/024 206/427
2015/0321817 A1 * 11/2015 Spivey, Sr. ..... B65D 71/72 206/429

* cited by examiner

PACKING BOX

CROSS-REFERENCE TO RELATED APPLICATIONS

This application is based on and claims priority under 35 USC 119 from Japanese Patent Application No. 2017-016391 filed on Feb. 1, 2017 and Japanese Patent Application No. 2017-016392 filed on Feb. 1, 2017.

BACKGROUND

1. Technical Field

The present invention relates to a packing box.

2. Related Art

Among conventional packing boxes having flaps some of whose tip portions are folded to form reinforcement portions are ones that have inside flaps, reinforcement portions that are formed by folding tip portions of the inside flaps, respectively, and a pair of outside flaps that cover the inside flaps and in which the reinforcement portions are disposed in such a manner that two end portions of each reinforcement portion are in contact with respective surfaces that are continuous with the respective outside flaps approximately in the vertical direction.

SUMMARY

According to an aspect of the invention, there is provided a packing box in which at least part of an opening through which to insert and take out an object to be packed is closed by inside lids that are opposed to each other in a plane, wherein the inside lids have a cut portion including a cut that is shaped so as to be suitable for the external shape of a portion of the object and folded portions formed by folding the respective inside lids, and, when the inside lids are closed, the cut is fitted with the portion of the object housed in the packing box to fix the object in a state that walls, opposed to each other, of the respective folded portions are in contact with each other.

BRIEF DESCRIPTION OF THE DRAWINGS

Exemplary embodiments of the present invention will be described in detail based on the following figures, wherein.

DESCRIPTION OF SYMBOLS

Figure 1:
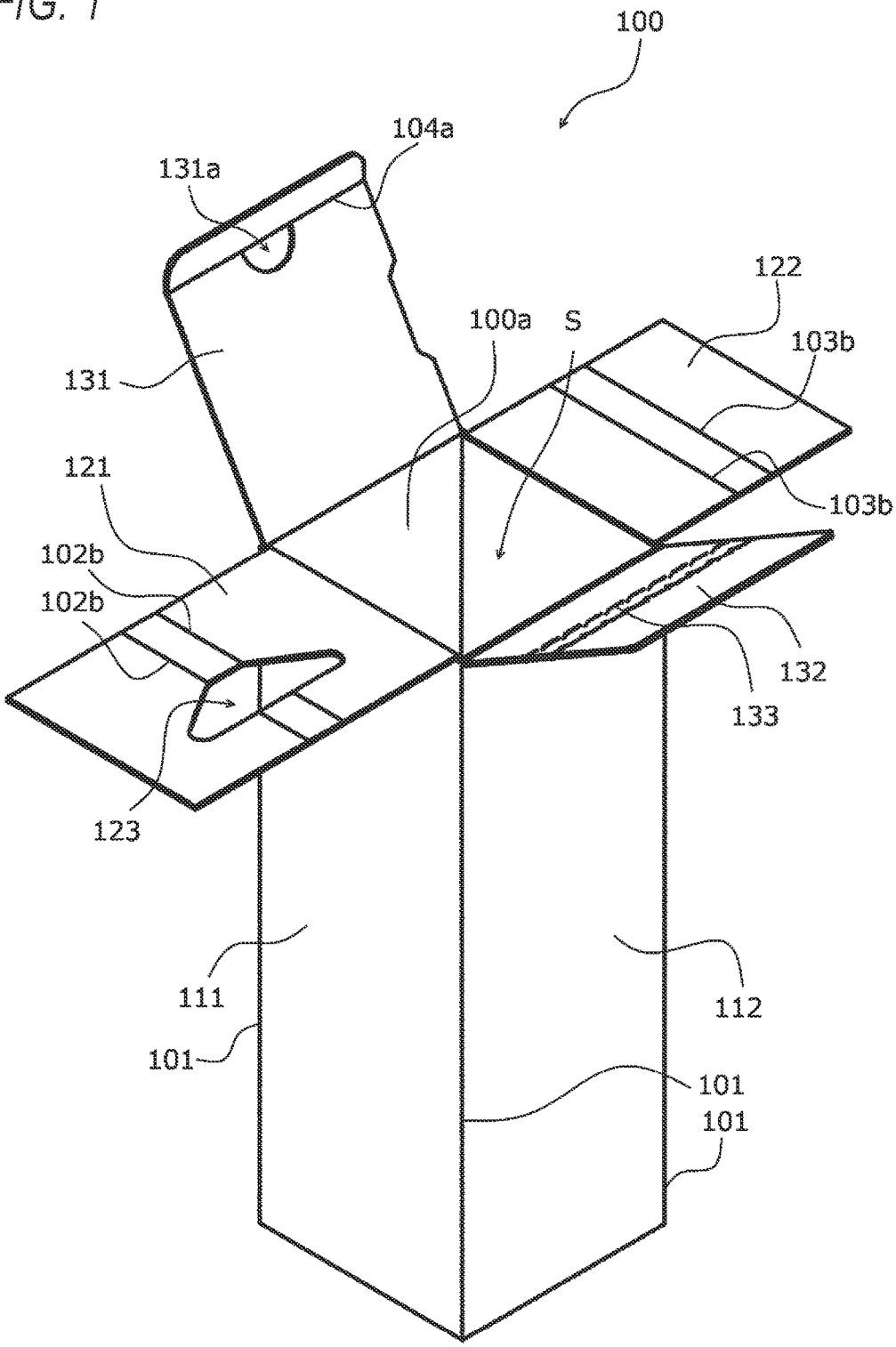
FIG. 1 is a perspective view of a packing box according to a first exemplary embodiment in a state that a first inside lid, a second inside lid, a first outside lid, and a second outside lid are opened.

100, 100A, 100B, 100C, 100D: Packing box
101: First folding line
102: Second folding line
103: Third folding line
104: Fourth folding line
105: Fifth folding line
106: Sixth folding line
102*a*, 102*b*, 102*c*, 102*h*, 103*a*, 103*b*, 103*c*, 104*a*, 106*a*: Folding line
111, 112, 113, 114: Side plate
115: Connection piece
121, 1210: First inside lid
121A, 1210A, 122A, 1220A: Folded portion
121B, 1210B, 1210AB: Cut portion
123, 123A: Cut
121A1: Tip portion
122, 1220: Second inside lid
122A, 1220A: Folded portion
131: First outside lid
132: Second outside lid
133: Separation piece
141, 142, 143, 144: Bottom plate
150, 150A: Post
M1, M2: Mark
TC: Object to be packed

DETAILED DESCRIPTION

The present invention will be hereinafter described in detail with reference to the drawings using specific examples as exemplary embodiments. However, the invention should not be construed as being restricted by these specific examples as the exemplary embodiments.

It is noted with regard to descriptions that will be made below with reference to the drawings that the drawings are schematic ones and ratios between dimensions, for example, are different from real ones. And members other than ones that are necessary for a description will be omitted as appropriate to facilitate understanding.

Exemplary Embodiment 1

(1) Configuration of Packing Box

Figure 2:
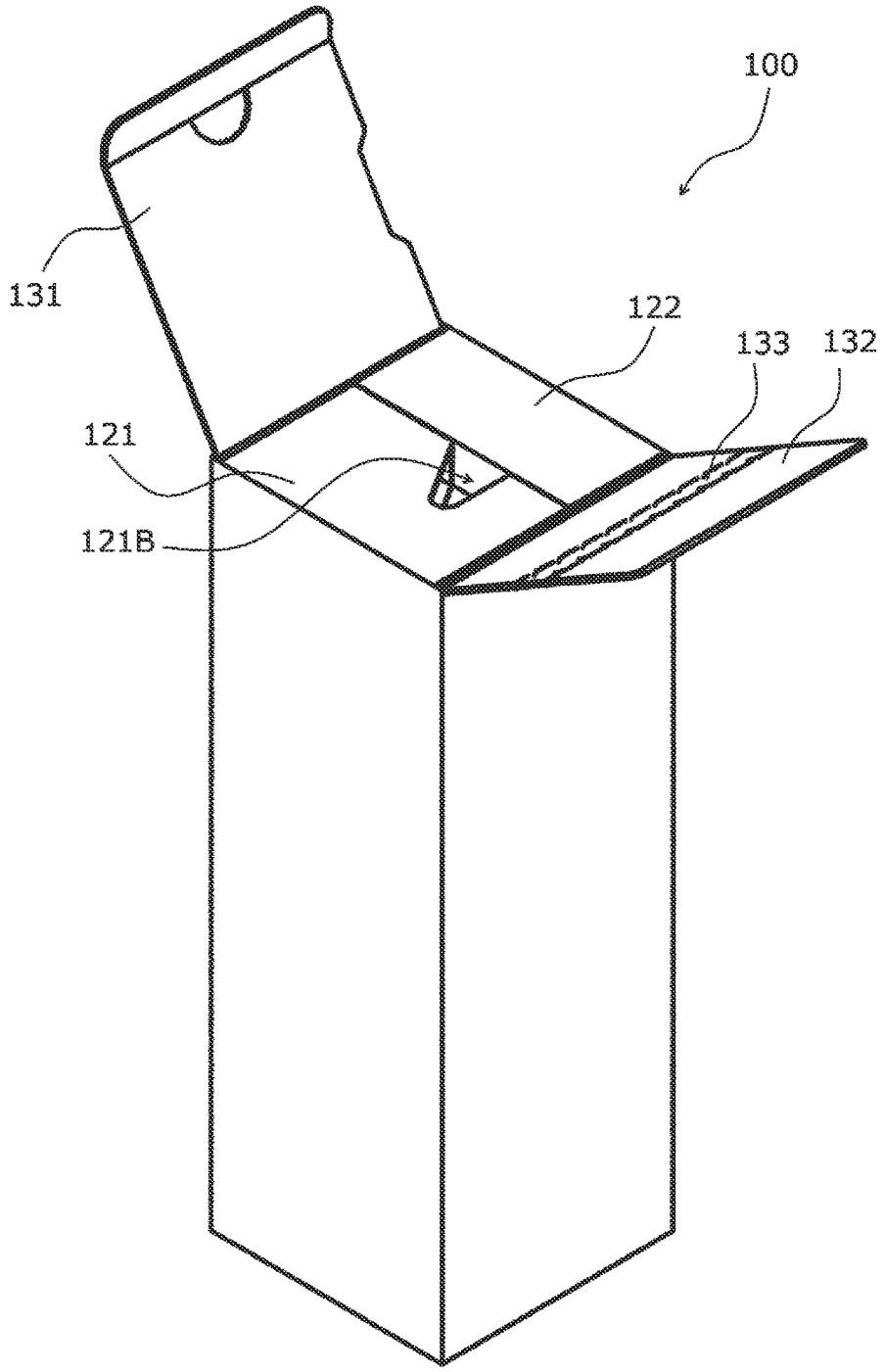
FIG. 2 is a perspective view of the packing box according to the first exemplary embodiment in a state that the first inside lid and the second inside lid are closed.
Figure 3:
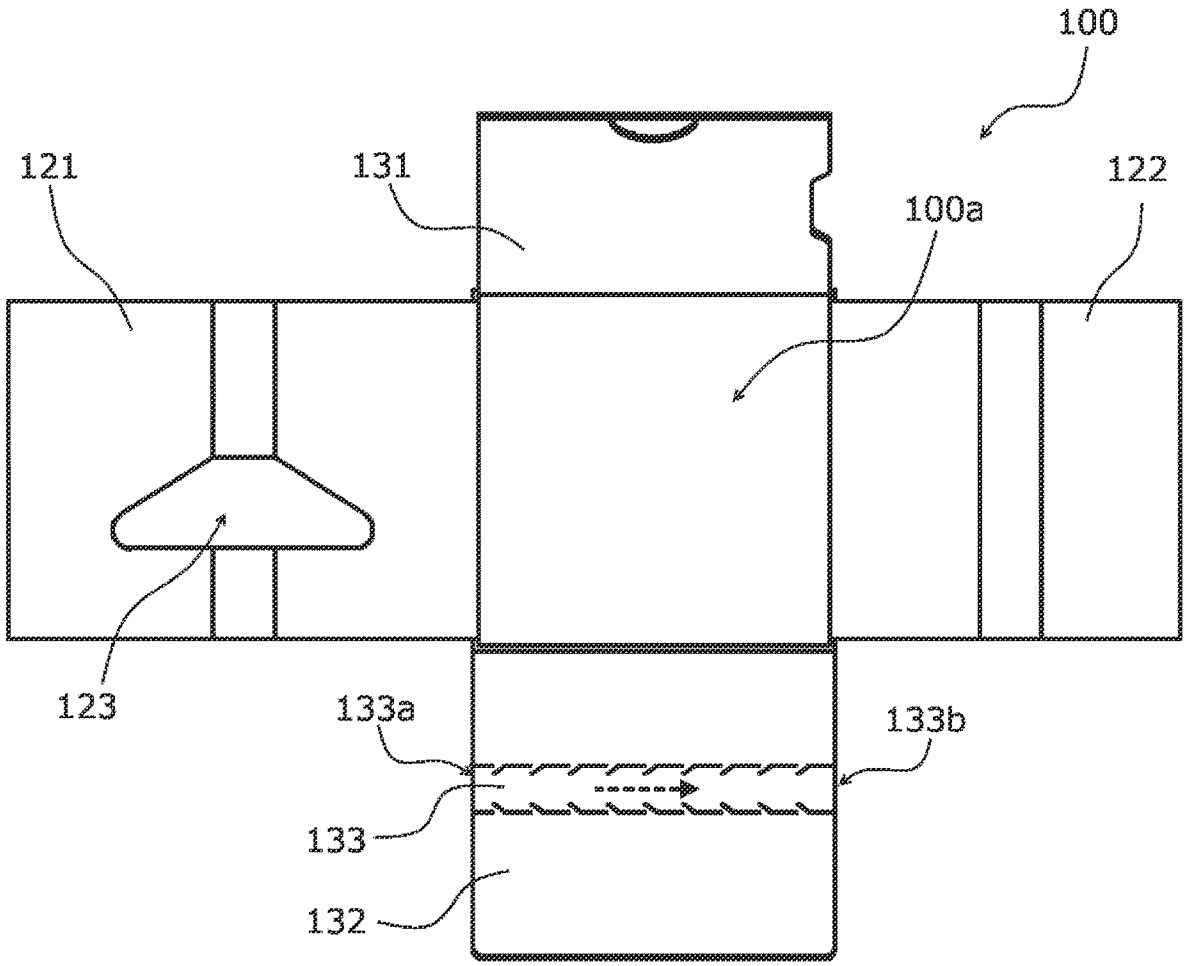
FIG. 3 is a plan view of the packing box according to the first exemplary embodiment in a state that the first inside lid, the second inside lid, the first outside lid, and the second outside lid are opened.
Figure 4:
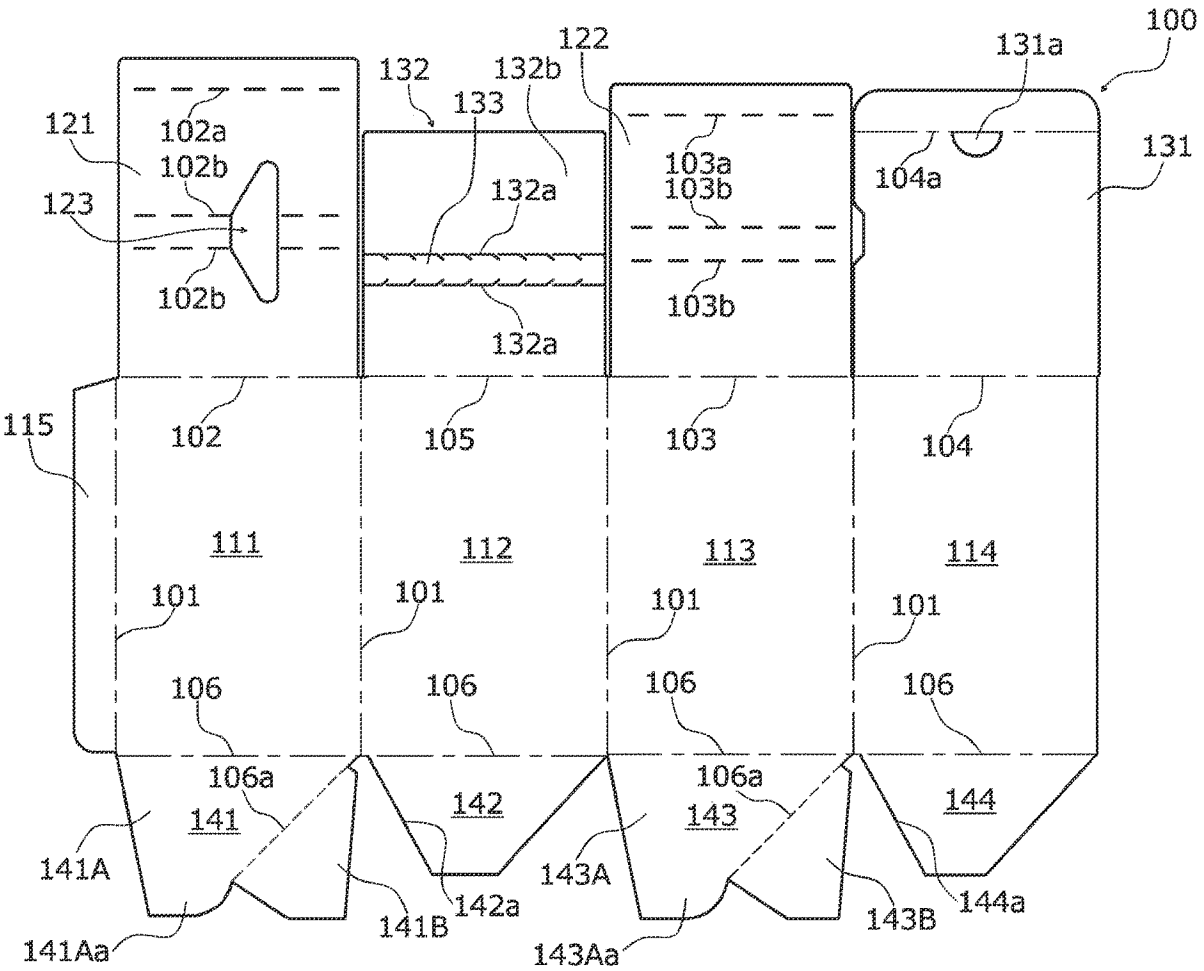
FIG. 4 is a development view of the packing box according to the first exemplary embodiment.

FIG. 1 is a perspective view of a packing box 100 in a state that a first inside lid 121, a second inside lid 122, a first outside lid 131, and a second outside lid 132 are opened. FIG. 2 is a perspective view of the packing box 100 in a state that the first inside lid 121 and the second inside lid 122 are closed. FIG. 3 is a plan view of the packing box 100 in a state that the first inside lid 121, the second inside lid 122, the first outside lid 131, and the second outside lid 132 are opened. FIG. 4 is a development view of the packing box 100. The configuration of the packing box 100 will be described below with reference to the related drawings.

(1.1) Overall Configuration of Packing Box

As shown in FIGS. 1 and 2, the packing box 100 is shaped like a rectangular prism and has four side plates 111, 112, 113, and 114 that are continuous with each other at first folding lines 101. As shown in the development view of FIG. 4, to connect the side plates 111 and 114, the side plate 111 has a connection piece 115 that is connected to the side plate 111 at one of the first folding lines 101 (indicated by a chain line in FIG. 4).

A box-shaped body that has a rectangular prism-shaped inside space S enclosed by the four side plates 111, 112, 113, and 114 and an opening 100*a* through which to insert and take out an object TC to be packed (i.e., to be put in the inside space S) is formed by making mountain folds over the four respective first folding lines 101 and bonding the connection piece 115 to the side plate 114 that are set so that the first folding line 101 that bounds the connection piece 115 coincides with the edge of the side plate 114.

The side plate 111 is continuous with the first inside lid 121 at a second folding line 102 (indicated by a chain line in FIG. 4) which crosses (is perpendicular to) the first folding lines 101 that bound the side plate 111. The first inside lid 121, which serves to close one side portion of the opening 100*a*, is formed with, near its tip edge, a folding line 102*a* (indicated by a broken line in FIG. 4) that crosses (is perpendicular to) extensions of the first folding lines 101 that bound the side plate 111. Thus, a tip portion of the first inside lid 121 can be valley-folded by about 90°.

The first inside lid 121 is formed with, approximately at the center, two folding lines 102*b* (indicated by broken lines in FIG. 4) which are spaced from each other and cross (are perpendicular to) extensions of the first folding lines 101 that bound the side plate 111. The first inside lid 121 is formed with a cut 123 that cross the two folding lines 102*b* and is to be fitted with a portion TCa of the object TC to be packed (described later).

The side plate 113 is continuous with the second inside lid 122 at a third folding line 103 (indicated by a chain line in FIG. 4) which crosses (is perpendicular to) the first folding lines 101 that bound the side plate 113 and extends in the same direction as the second folding line 102. The second inside lid 122, which serves to close the other side portion of the opening 100*a* (its one side portion is closed by the first inside lid 121), is formed with, near its tip edge, a folding line 103*a* (indicated by a broken line in FIG. 4) that crosses (is perpendicular to) extensions of the first folding lines 101 that bound the side plate 113. A tip portion of the second inside lid 122 can be valley-folded by about 90°.

The second inside lid 122 is formed with, approximately at the center, two folding lines 103*b* (indicated by broken lines in FIG. 4) which are spaced from each other and cross (are perpendicular to) extensions of the first folding lines 101 that bound extensions of the side plate 113.

The side plate 114 is continuous with the first outside lid 131 at a fourth folding line 104 (indicated by a chain line in FIG. 4) which crosses (is perpendicular to) the first folding line 101 that bounds the side plate 114 and extends approximately in the same direction as the second folding line 102. The first outside lid 131, which is a cover member for covering the first inside lid 121 and the second inside lid 122 in an openable manner, is formed with, near its tip edge, a folding line 104*a* (indicated by a chain line in FIG. 4) which crosses (is perpendicular to) an extension of the first folding line 101 that bounds the side plate 114. A tip portion of the first outside lid 131 is mountain-folded by about 90°.

The first outside lid 131 is formed with a hole 131*a* approximately at the center of the folding line 104*a* so that the first outside lid 131 can be opened by hooking a finger on the edge of the hole 131*a*.

The side plate 112 is continuous with the second outside lid 132 at a fifth folding line 105 (indicated by a chain line in FIG. 4) which crosses (is perpendicular to) the first folding lines 101 that bound the side plate 112 and extends approximately in the same direction as the second folding line 102. The second outside lid 132 is a cover member for covering the first outside lid 131. The second outside lid 132 is bonded to the closed first outside lid 131 with adhesive, for example, whereby the first inside lid 121, the second inside lid 122, and the first outside lid 131 are locked on each other and prevented from opening.

The second outside lid 132 is formed with, approximately at the center, two perforation lines 132*a* which are parallel with each other and define a separation piece 133 between them. To open the packing box 100, a tip portion 133*a* of the separation piece 133 is held by fingers and pulled toward its base portion 133*b* (indicated by an arrow in FIG. 3), whereby the separation piece 133 is cut off from the second outside lid 132 along the perforation lines 132*a*.

As shown in FIG. 4, on the side opposite to the first inside lid 121, the second inside lid 122, the first outside lid 131, and the second outside lid 132, the side plates 111, 112, 113, and 114 are continuous with bottom plates 141, 142, 143, and 144 at sixth folding lines 106 (indicated by chain lines in FIG. 4), respectively.

The bottom plate 141 is composed of a first bottom plate 141A and a second bottom plate 141B which become narrower as the position goes away from the corresponding sixth folding line 106. The tip edge of the bottom plate 141 is formed with a triangular cut approximately at the center, and the bottom plate 141 is formed with a folding line 106*a* (indicated by a broken line in FIG. 4) which extends from the inner apex of the triangular cut to one end of the sixth folding line 106 of the bottom plate 141. On the other hand, the bottom plate 142 which is adjacent to the bottom plate 141 in a developed state is shaped so as to become narrower while being kept approximately symmetrical with respect to its center line that is perpendicular to the corresponding sixth folding line 106 as the position goes away from the corresponding sixth folding line 106.

The bottom plates 141 and 142 having the above-described shapes are bonded to each other so that the folding line 106*a* of the bottom plate 141 coincides with one side 142*a* of the bottom plate 142 when the combination of the side plates 111 and 112 is folded along the first folding line 101 bounding them. A tip portion of the first bottom plate 141A becomes an insertion piece 141Aa.

The bottom plates 143 and 144 are shaped in the same manners as the bottom plates 141 and 142, respectively. The bottom plates 143 and 144 are bonded to each other so that a folding line 106*a* (indicated by a broken line in FIG. 4) of the bottom plate 143 coincides with one side 144*a* of the bottom plate 144 when the combination of the side plates 113 and 114 is folded along the first folding line 101 bounding them. A tip portion of a first bottom plate 143A becomes an insertion piece 143Aa.

The bottom plates 141 and 143 are valley-folded along the respective folding lines 106*a*, the insertion piece 141Aa is inserted between the bonding portions of the bottom plates 143 and 144, and the insertion piece 143Aa is inserted between the bonding portions of the bottom plates 141 and 142. As a result, a bottom portion is formed that does not open easily.

(2) Inside Lids

Figure 5:
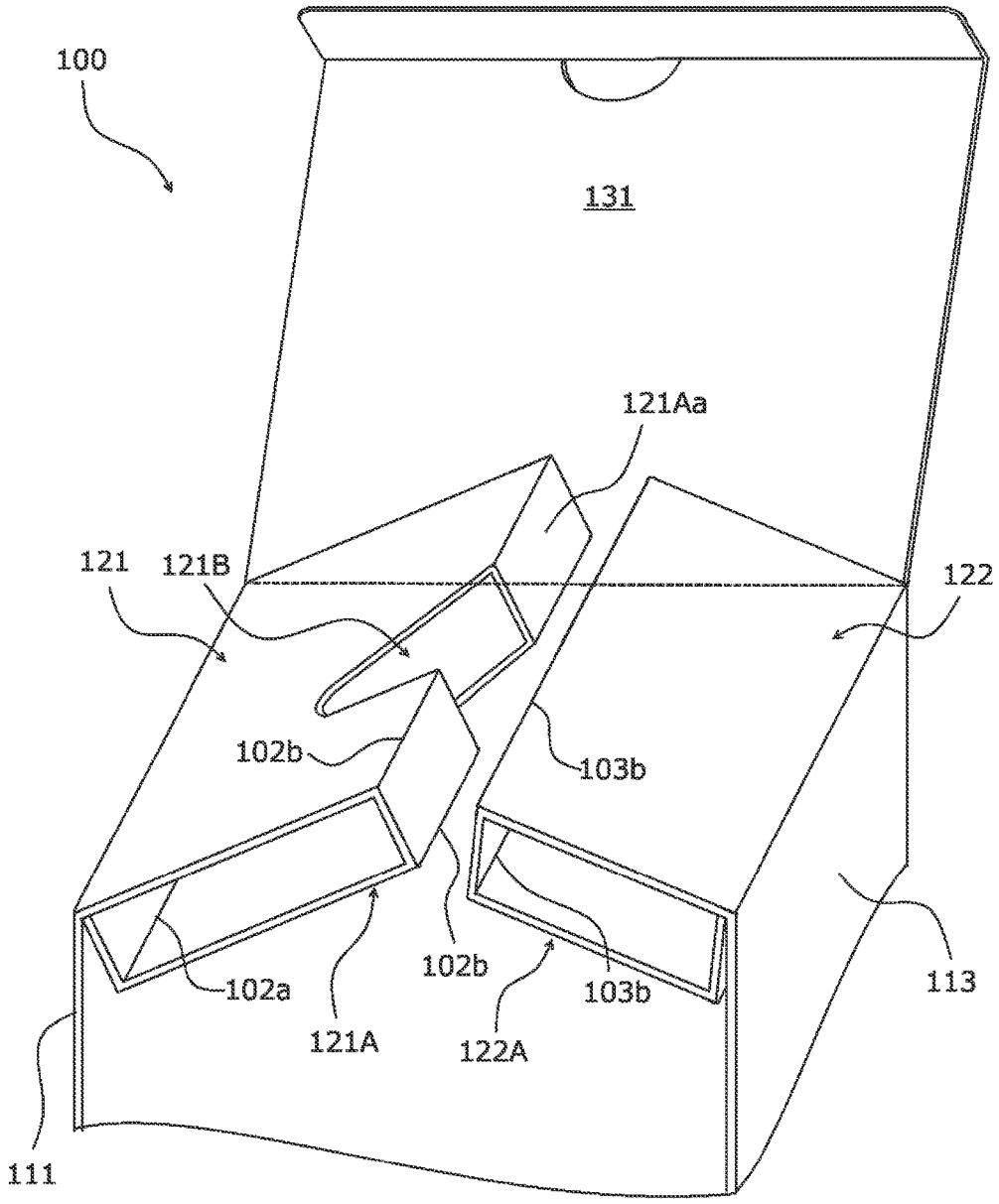
FIG. 5 is a perspective view showing part of the packing box according to the first exemplary embodiment in a state that the first inside lid and the second inside lid are folded into respective folded portions, with one side plate omitted.
Figure 6A:
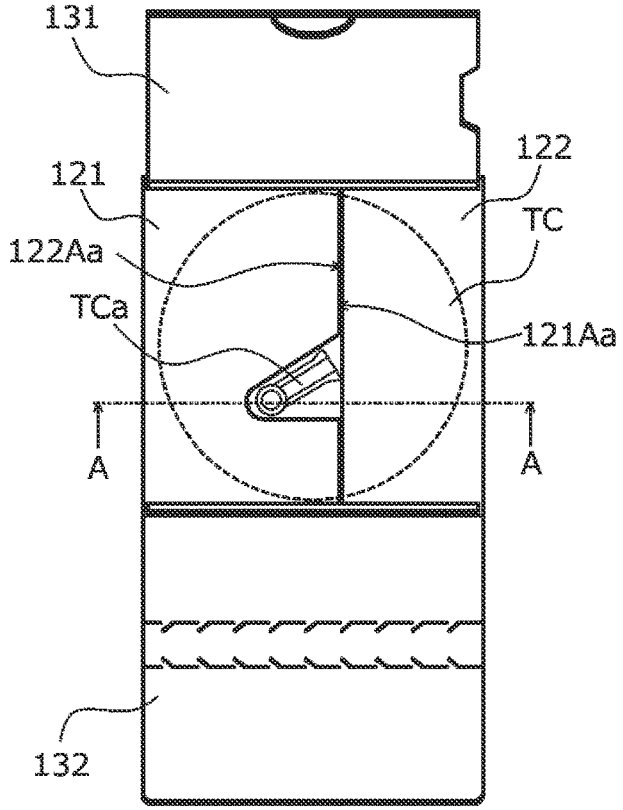
FIG. 6A is a schematic plan view of the packing box according to the first exemplary embodiment in a state that an object is housed therein and the first inside lid and the second inside lid are closed.
Figure 6B:
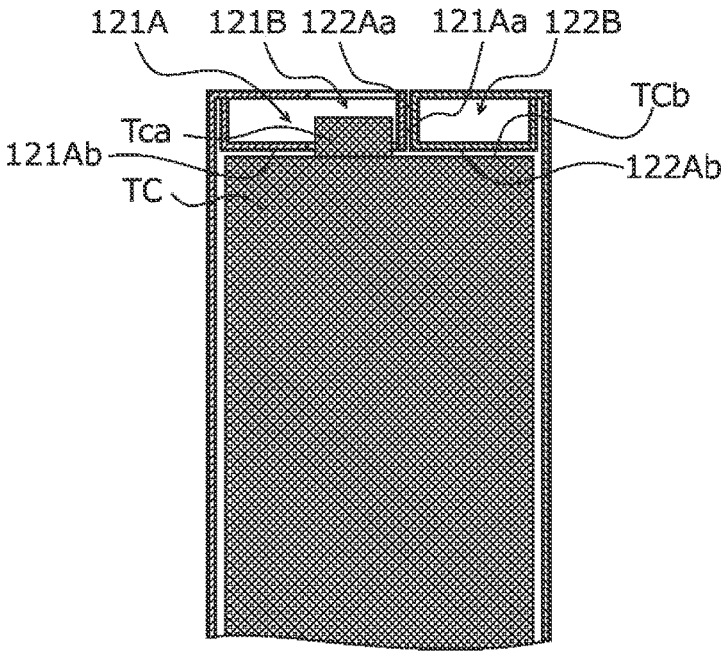
FIG. 6B is a schematic sectional view taken along line A-A in FIG. 6A.
Figure 7:
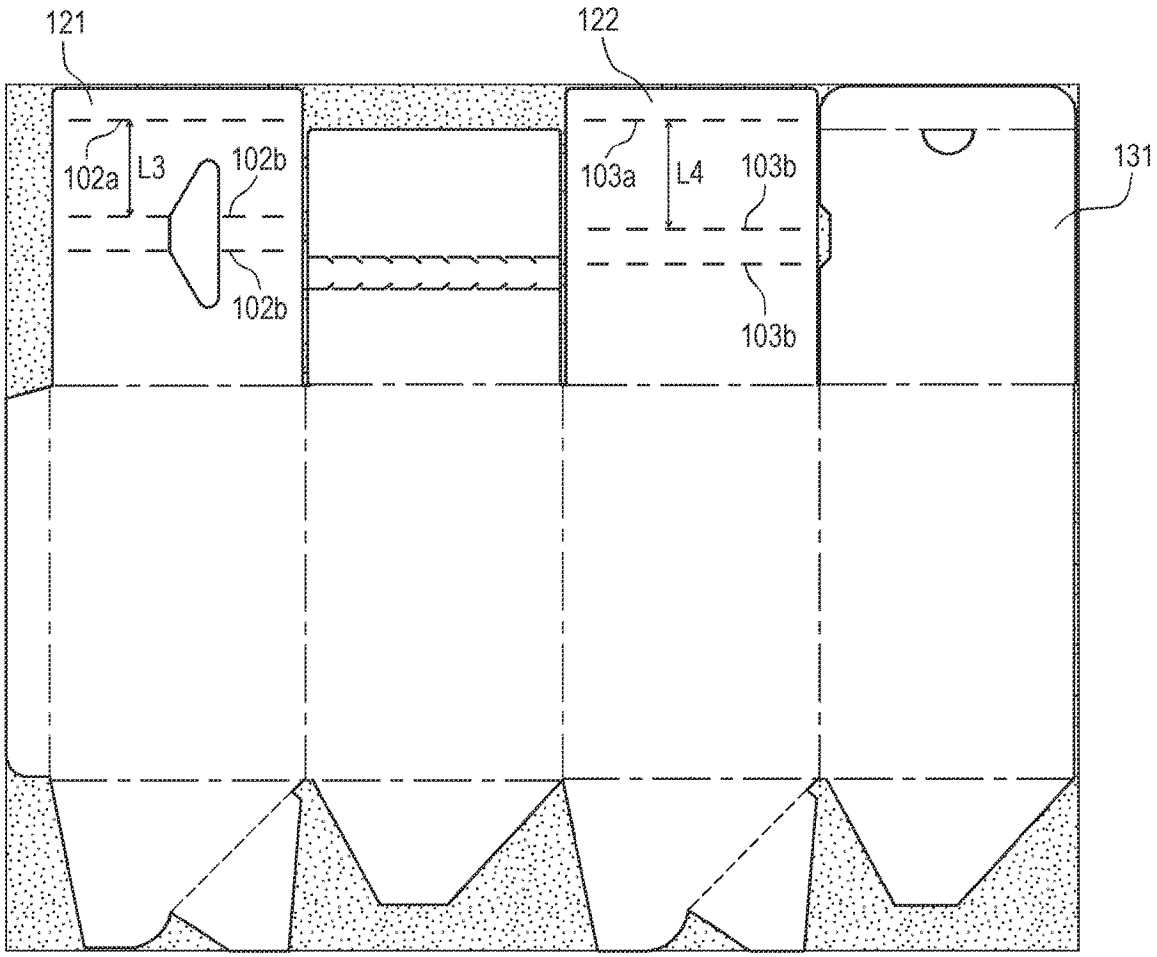
FIG. 7 is a development view of another packing box according to the first exemplary embodiment in which the first inside lid and the second inside lid are within the length of the first outside lid in the direction that is perpendicular to a fourth folding line.
Figure 8:
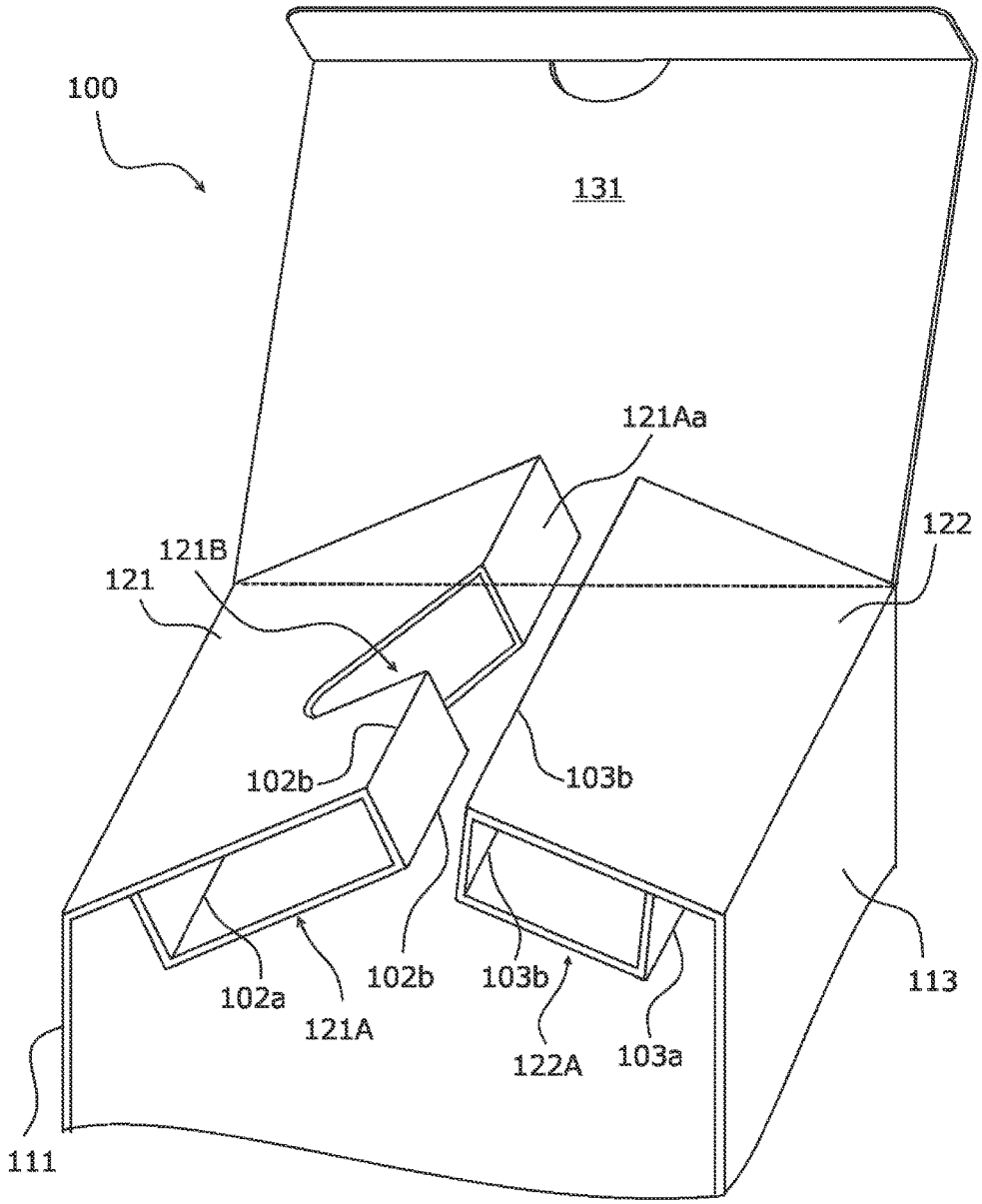
FIG. 8 is a perspective view of part of the packing box whose development view is shown in FIG. 7.
Figure 9A:
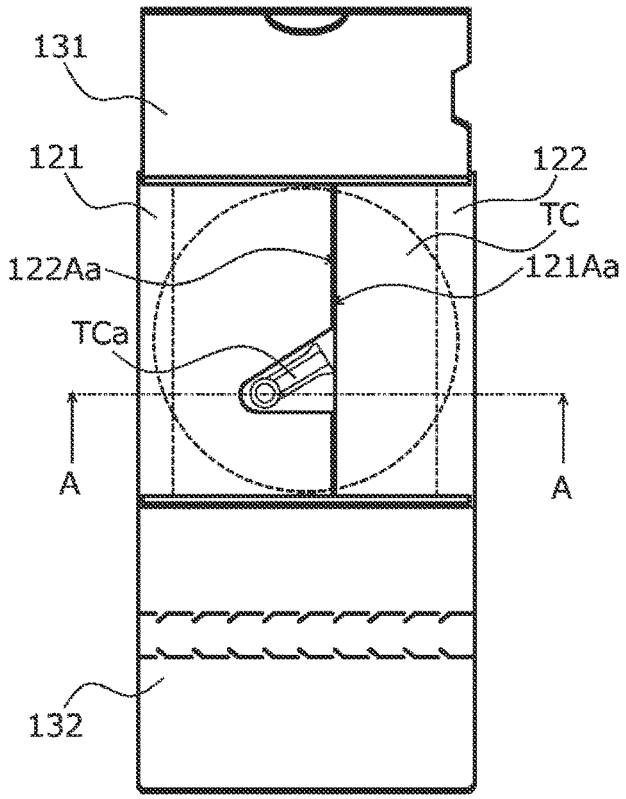
FIG. 9A is a schematic plan view of the packing box whose development view is shown in FIG. 7.
Figure 9B:
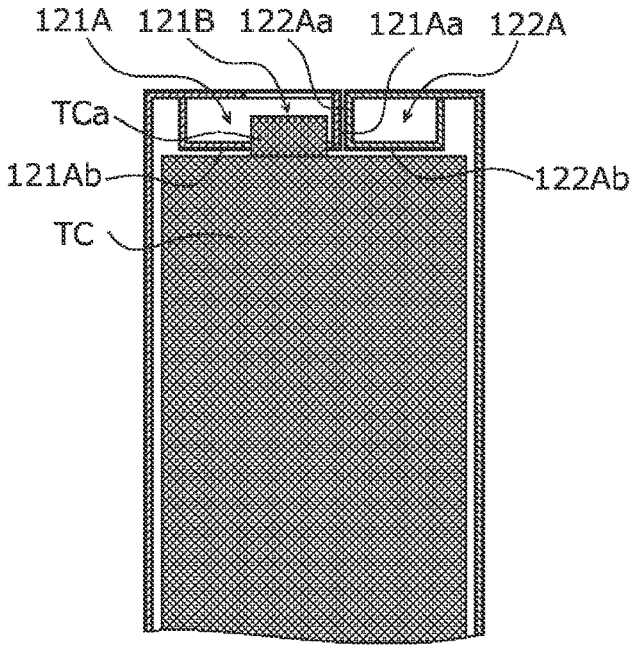
FIG. 9B is a schematic sectional view taken along line A-A in FIG. 9A.

FIG. 5 is a perspective view showing part of the packing box 100 in a state that the first inside lid 121 and the second inside lid 122 are folded into respective folded portions 121A and 122A, with the side plate 112 omitted. FIG. 6A is a schematic plan view of the packing box 100 in a state that the object TC is housed therein and the first inside lid 121 and the second inside lid 122 are closed, and FIG. 6B is a schematic sectional view taken along line A-A in FIG. 6A. FIG. 7 is a development view of a packing box 100 in which the first inside lid 121 and the second inside lid 122 are within the length of the first outside lid 131 in the direction that is perpendicular to the fourth folding line 104. FIG. 8 is a perspective view of part of the packing box 100 whose development view is shown in FIG. 7. FIG. 9A is a schematic plan view of the packing box 100 whose development view is shown in FIG. 7, and FIG. 9B is a schematic sectional view taken along line A-A in FIG. 9A.

The structures of the first inside lid 121 and the second inside lid 122 of each packing box 100 according to the exemplary embodiment will be described below with reference to the related drawings.

In each packing box 100, the object TC that is put in the inside space S is fixed by closing the opening 100*a* by the first inside lid 121 and the second inside lid 122.

The first inside lid 121 has the folded portion 121A which is formed by making valley folds over the folding lines 102*a* and 102*b* so as to form angles of about 90°. As shown in FIG. 5, the folded portion 121A is shaped like a hollow rectangular prism and its tip portion (opposite to the second folding line 102) is formed with a cut portion 121B that crosses the two folding lines 102*b*.

The second inside lid 122 has the second folded portion 122A which is formed by making valley folds over the folding lines 103*a* and 103*b* so as to form angles of about 90°. As shown in FIG. 5, the folded portion 122A is shaped like a hollow rectangular prism.

The first inside lid 121 and the second inside lid 122 having the above structures are closed by making mountain folds over the second folding line 102 and the third folding line 103 with the object TC put in the inside space S, as a result of which a projected portion TCa of the object TC fits into the cut portion 121B of the folded portion 121A and the object TC is prevented from rotating in the inside space S.

As shown in FIG. 6B, in a state that the opening 100*a* is closed by the first inside lid 121 and the second inside lid 122, a wall 121Aa, opposed to the folded portion 122A, of the folded portion 121A and a wall 122Aa, opposed to the folded portion 121A, of the folded portion 122A are in contact with each other. A back surface 121Ab, located on the side of the inside space S, of the folded portion 121A and a back surface 122Ab, located on the side of the inside space S, of the folded portion 122A are in contact with a surface TCb, located on the side of the opening 100*a*, of the object TC, whereby the object TC is fixed.

This makes it unnecessary to use a pad that conforms to the external shape of the object TC and the internal shape of a packing box and to press the pad by inside lids. This also makes it possible to reduce impact that acts on the surface TCb, located on the side of the opening 100*a* of the packing box 100, of the object TC.

As shown in FIGS. 5 and 6A, the cut portion 121B is formed in a tip portion of the folded portion 121A so as to be registered with the portion TCa of the object TC. The cut portion 121B is formed at such a position that the portion TCa of the object TC housed in the packing box 100 can be seen through it from outside in a state that the first inside lid 121 is closed, in such a manner as to penetrate through the folded portion 121A in the direction in which the object TC is inserted into and taken out of the packing box 100. This makes it possible to easily recognize whether the object TC is housed in the packing box 100 with correct orientation even in a state that the first inside lid 121 and the second inside lid 122 are closed.

To reduce a cutting loss of manufacture of the packing box 100, it is preferable that the first inside lid 121 and the second inside lid 122 be within the length of the first outside lid 131 in the direction that is perpendicular to the fourth folding line 104.

More specifically, as shown in the development view of FIG. 7, the first inside lid 121 and the second inside lid 122 are formed so as to have the same length in the direction perpendicular to the first to fourth folding lines 101-104 as the first outside lid 131 which is longest in this direction in the packing box 100 completed. Thus, the length L3 between the folding line 102*a* and the one, closer to it, of the two folding lines 102*b* and the length L4 between the folding line 103*a* and the one, closer to it, of the two folding lines 103*b* are shortened (see FIG. 8).

As shown in FIGS. 9A and 9B, in a state that the first inside lid 121 and the second inside lid 122 are closed, a wall 121Aa, opposed to the folded portion 122A, of the folded portion 121A and a wall 122Aa, opposed to the folded portion 121A, of the folded portion 122A are in contact with each other. This makes it possible to fix the object TC while decreasing a cutting loss (dark portions in FIG. 7) of manufacture of the packing box 100 and reducing impact acting on the object TC.

Where the packing box 100 is made of known corrugated cardboard in which front and back liners and a corrugated core sheet are laminated together using adhesive, for example, it is desirable that the folded portions 121A and 122A be arranged in a direction orthogonal to the direction in which the flutes of the corrugated cardboard extend. This makes the packing box 100 stronger in the direction in which the folded portions 121A and 122A are in contact with each other, and thereby makes it possible to fix the object TC while reducing impact acting on it.

(3) Outside Lids

Figure 10:
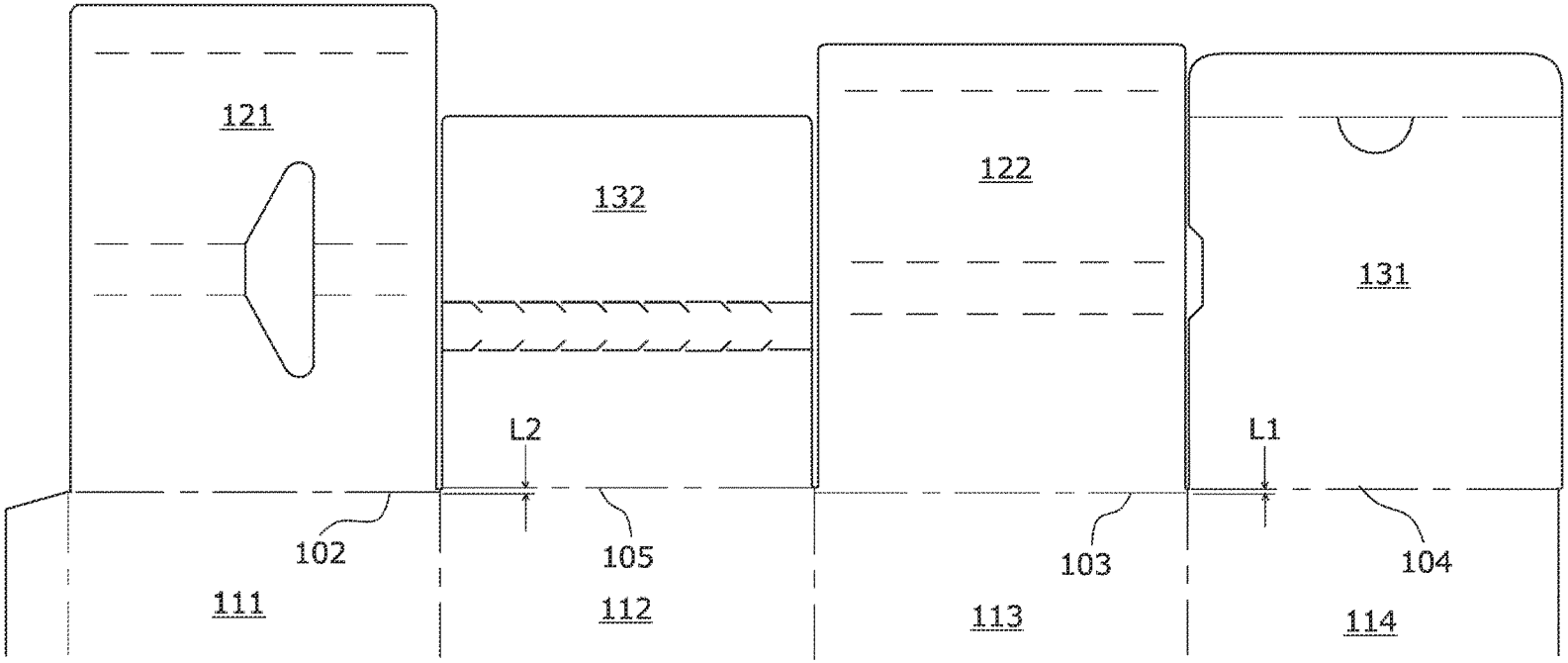
FIG. 10 is an enlarged view of a part, including the first inside lid, the second inside lid, the first outside lid, and the second outside lid and their vicinities, of FIG. 4.
Figure 11:
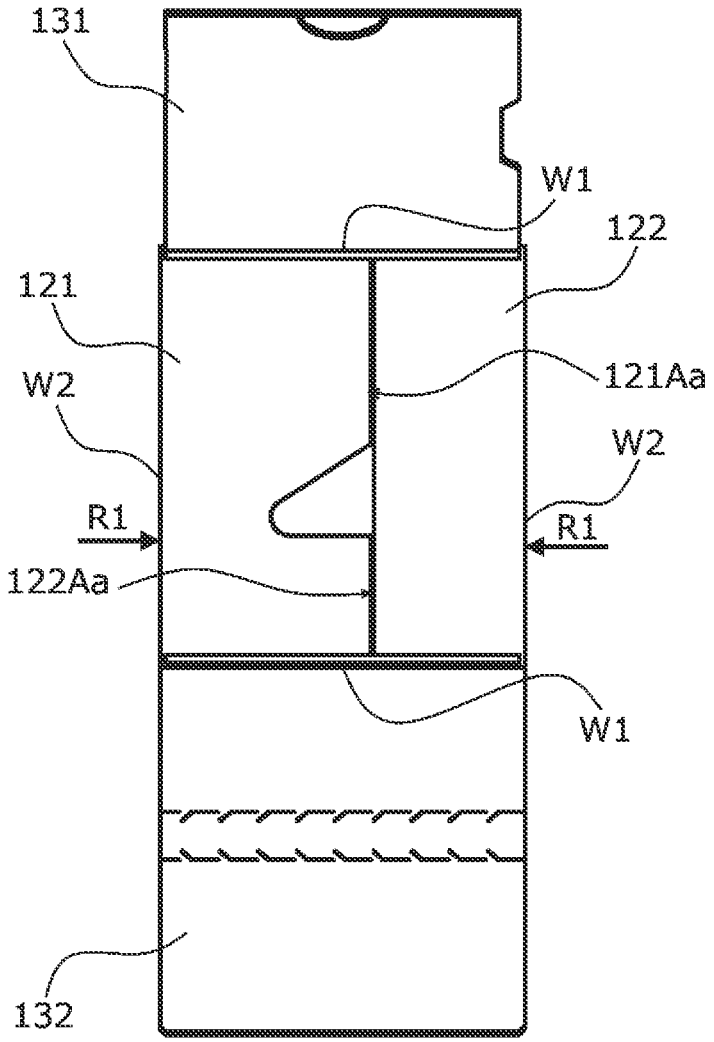
FIG. 11 is a schematic plan view of a packing box in which the first outside lid and the second outside lid adjoining shorter sides of an opening.
Figure 12:
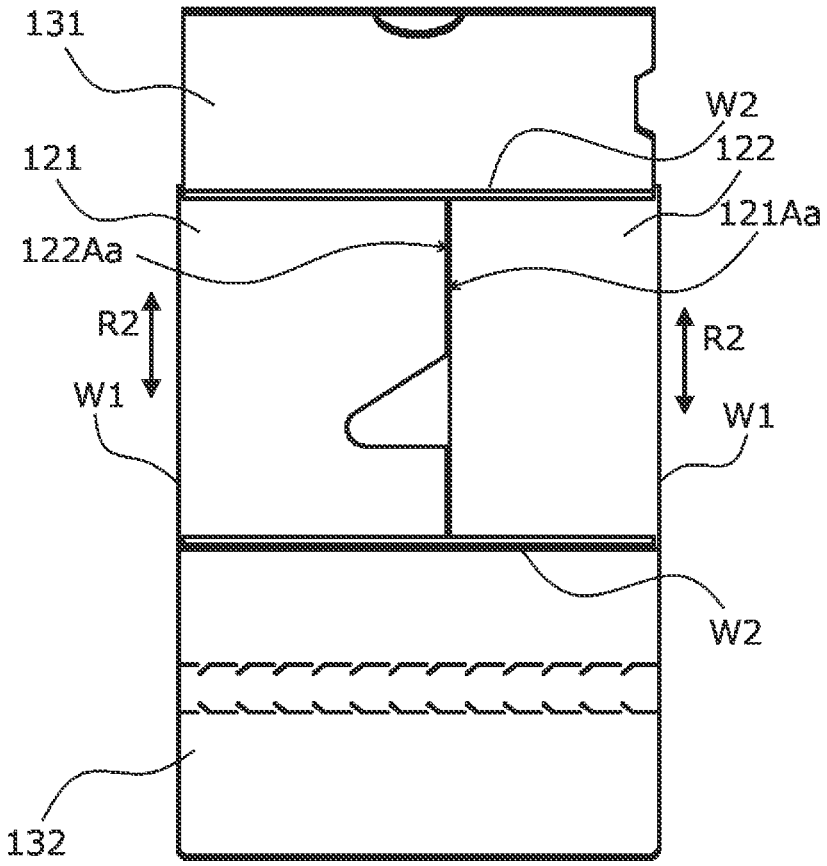
FIG. 12 is a schematic plan view of a packing box in which the first outside lid and the second outside lid adjoining longer sides of the opening.

FIG. 10 is an enlarged view of a part, including the first inside lid 121, the second inside lid 122, the first outside lid 131, and the second outside lid 132 and their vicinities, of FIG. 4. FIG. 11 is a schematic plan view of a packing box 100 in which the first outside lid 131 and the second outside lid 132 adjoining shorter sides W1 of the opening 100*a*. FIG. 12 is a schematic plan view of a packing box 100 in which the first outside lid 131 and the second outside lid 132 adjoining longer sides W2 of the opening 100*a*.

In the packing box 100, in a state that the object TC that is put in the inside space S is fixed by closing the opening 100*a* by the first inside lid 121 and the second inside lid 122, the first inside lid 121 and the second inside lid 122 are covered with the first outside lid 131 by closing it and then the second outside lid 132 is folded and a bonding portion 132*b* (see FIG. 4), located on the tip side of the separation piece 133, of the second outside lid 132 is bonded, with adhesive, for example, to the surface of the first outside lid 131 which was closed earlier, whereby the first inside lid 121, the second inside lid 122, and the first outside lid 131 are locked and prevented from opening.

To take out the object TC by opening the packing box 100, the separation piece 133 is cut off from the second outside lid 132 to establish a state that the first outside lid 131 can be opened.

As indicated by symbol L1 in FIG. 10, the fourth folding line 104 (indicated by a chain line in FIG. 10) which is the boundary between the side plate 114 and the first outside lid 131 is located closer to the tip of the first outside lid 131 than an extension of the third folding line 103 (indicated by a chain line in FIG. 10) is which is the boundary between the side plate 113 and the second inside lid 122.

With this measure, when the first outside lid 131 and the first and second inside lids 121 and 122 are closed and the former is put on the latter, the thickness of the first inside lid 121 and the second inside lid 122 is absorbed by the length L1, that is, the distance between the extension of the third folding line 103 and the fourth folding line 104, and the first outside lid 131 is prevented from swelling.

As indicated by symbol L2 in FIG. 10, the fifth folding line 105 (indicated by a chain line in FIG. 10) which is the boundary between the side plate 112 and the second outside lid 132 is located closer to the tip of the second outside lid 132 than an extension of the second folding line 102 (indicated by a chain line in FIG. 10) is which is the boundary between the side plate 111 and the first inside lid 121.

With this measure, when the second outside lid 132 and the combination of the first outside lid 131, the first inside lids 121, and the second inside lid 122 are closed and the former is put on the latter, the thickness of the first inside lid 121 and the second inside lid 122 plus the thickness of the first outside lid 131 is absorbed by the length L2, that is, the distance between the extension of the second folding line 102 and the fifth folding line 105, and the second outside lid 132 is prevented from swelling.

Modification 1

As shown in FIG. 11, the first outside lid 131 and the second outside lid 132 are provided adjoining the shorter sides W1 of the opening 100*a* according to the external shape of the object TC.

Where the first outside lid 131 and the second outside lid 132 are provided adjoining the shorter sides W1 of the opening 100*a*, the first inside lid 121 and the second inside lid 122 are provided adjoining the longer sides W2 of the opening 100*a*, whereby the packing box 100 is made stronger in the direction (indicated by arrows R1 in FIG. 11) in which the folded portions 121A and 122A are in contact with each other and it becomes possible to fix the object TC while reducing impact acting on it.

Modification 2

As shown in FIG. 12, the first outside lid 131 and the second outside lid 132 are provided adjoining the longer sides W2 of the opening 100*a* according to the external shape of the object TC.

Where the first outside lid 131 and the second outside lid 132 are provided adjoining the longer sides W2 of the opening 100*a*, the first inside lid 121 and the second inside lid 122 are provided adjoining the shorter sides W1 of the opening 100*a*, whereby the packing box 100 is made stronger in the direction (indicated by arrows R2 in FIG. 12) that is parallel with the walls 121Aa and 122Aa of the folded portions 121A and 122A that are in contact with each other and it becomes possible to fix the object TC while reducing impact acting on it.

Exemplary Embodiment 2

Figure 13:
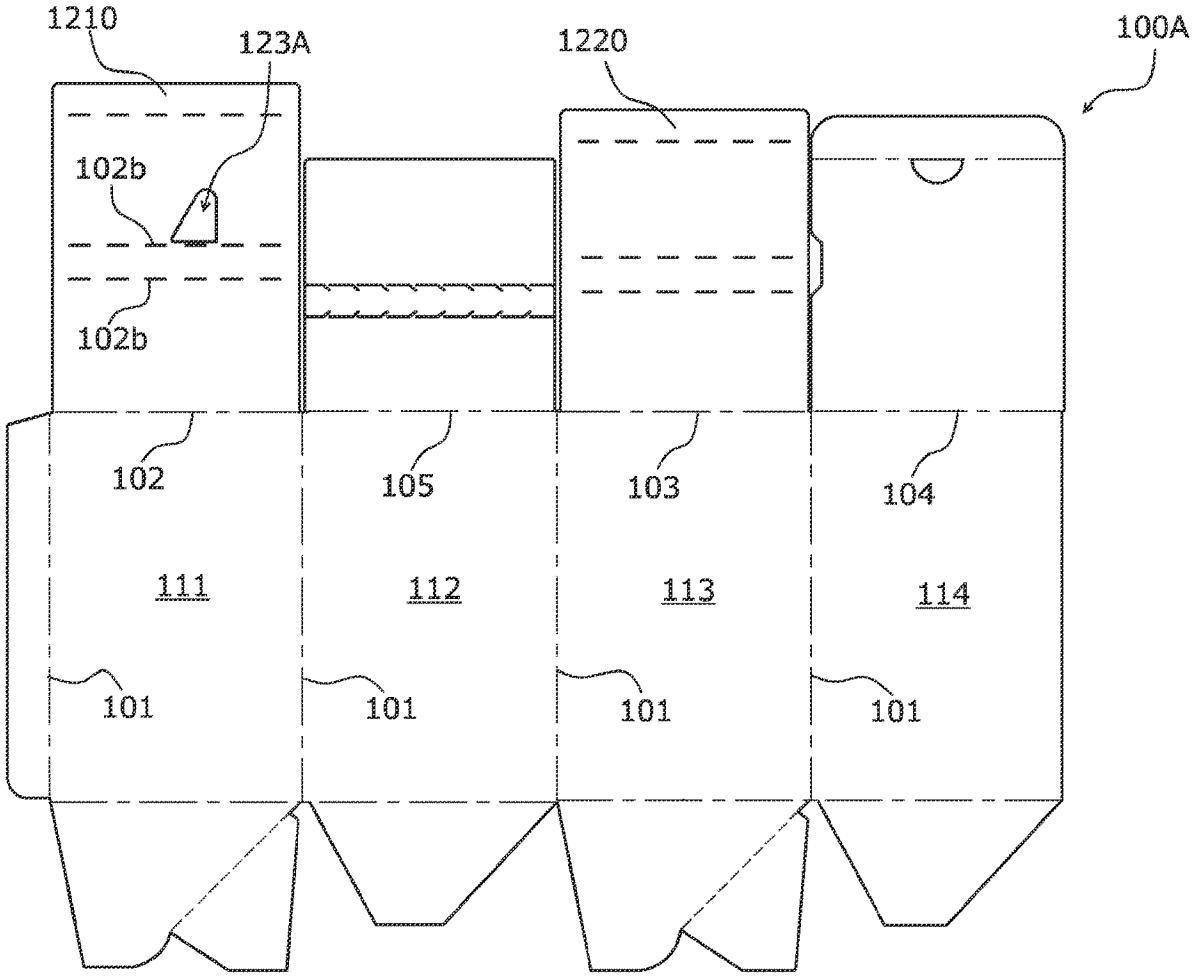
FIG. 13 is a development view of a packing box according to a second exemplary embodiment.
Figure 14:
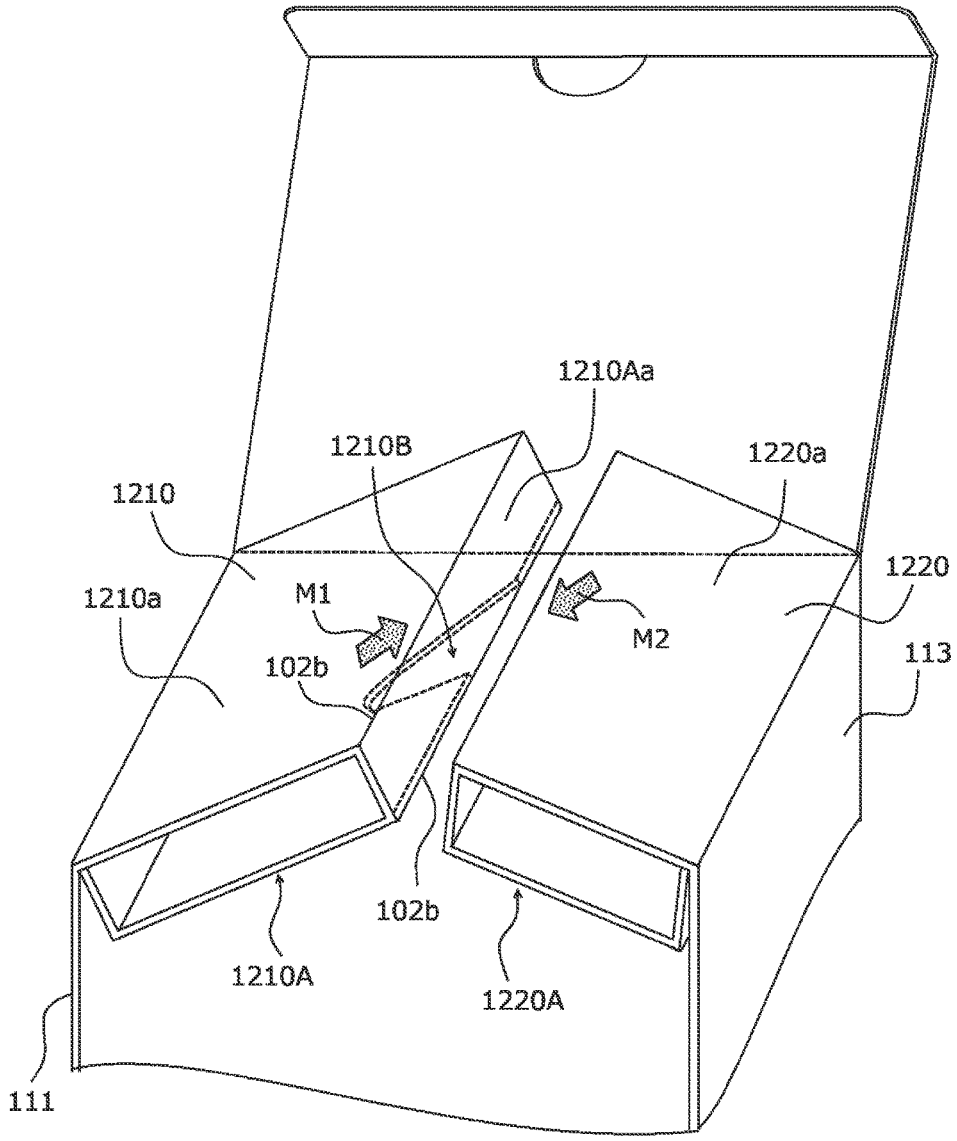
FIG. 14 is a perspective view showing part of the packing box according to the second exemplary embodiment with one side plate omitted.
Figure 15A:
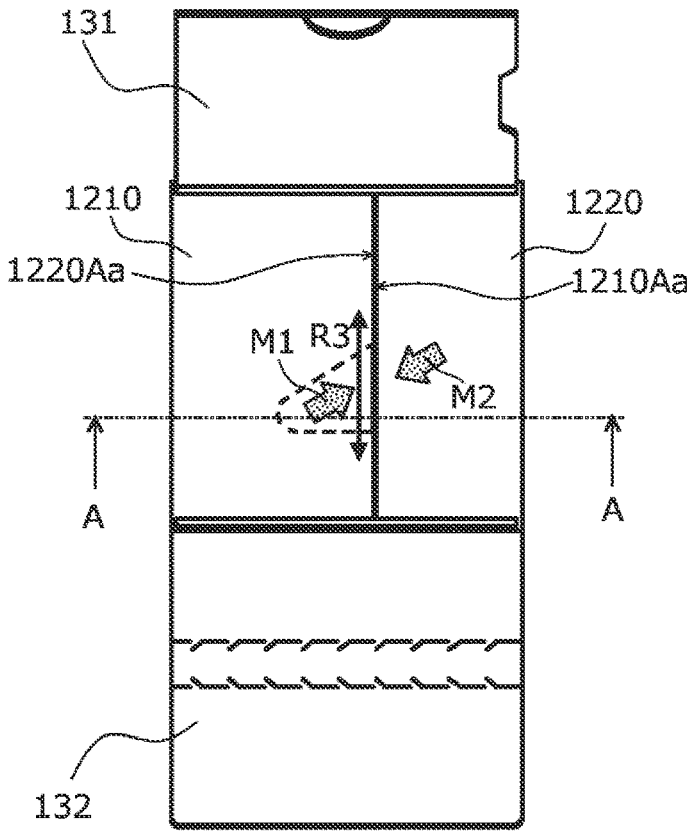
FIG. 15A is a schematic plan view of the packing box according to the second exemplary embodiment in a state that the object is housed therein and a first inside lid and a second inside lid are closed.
Figure 15B:
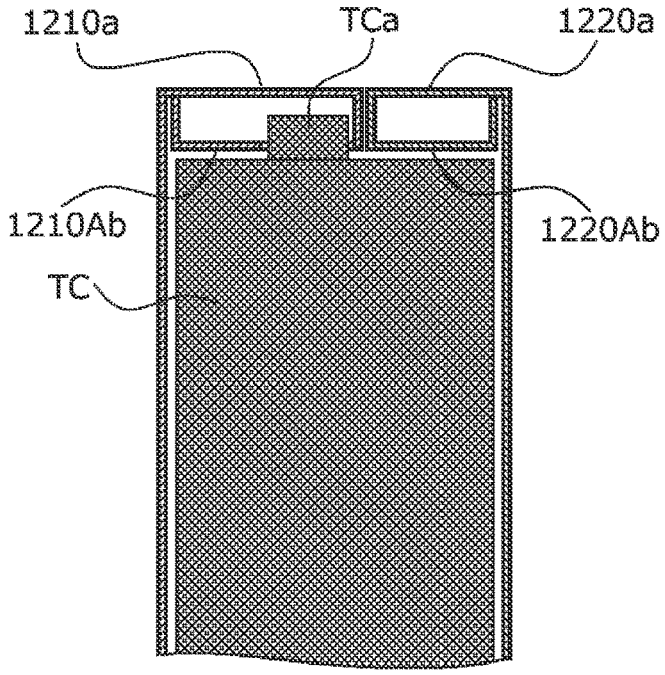
FIG. 15B is a schematic sectional view taken along line A-A in FIG. 15A.

FIG. 13 is a development view of a packing box 100A according to a second exemplary embodiment. FIG. 14 is a perspective view showing part of the packing box 100A with the side plate 112 omitted. FIG. 15A is a schematic plan view of the packing box 100A in a state that the object TC is housed therein and a first inside lid 1210 and a second inside lid 1220 are closed, and FIG. 15B is a schematic sectional view taken along line A-A in FIG. 15A.

The packing box 100A will be described below with reference to the related drawings. Constituent elements having the same ones in the packing box 100 according to the first exemplary embodiment will be given the same reference numerals as the latter, and detailed descriptions therefor will be omitted.

The packing box 100A according to the second exemplary embodiment is different from the packing box 100 according to the first exemplary embodiment in that no part of a cut portion 1210B is formed in a wall 1210Aa, opposed to a folded portion 1220A, of a folded portion 1210A, and that a mark M1 indicating the position of the portion TCa of the object TC is formed on the first inside lid 1210.

As shown in FIG. 13, the side plate 111 is continuous with the first inside lid 121 at the second folding line 102 (indicated by a chain line in FIG. 13) which crosses (is perpendicular to) the first folding lines 101 that bound the side plate 111. The first inside lid 121 is formed with, approximately at the center, two folding lines 102*b* (indicated by broken lines in FIG. 13) that are spaced from each other and cross (are perpendicular to) extensions of the first folding lines 101 that bound the side plate 111. The first inside lid 121 is formed with a cut 123A that is to be fitted with the portion TCa of the object TC, on the side, closer to the tip edge of the first inside lid 121, of the tip-side folding line 102*b*.

When the first inside lid 1210 having the above structure is folded along the folding lines 102*b* (see FIG. 14), as shown in FIGS. 15A and 15B no part of the cut portion 1210B is formed in the wall 1210Aa, to be opposed to and come into contact with a wall 1220Aa of the second inside lid 1220 when the first inside lid 1210 and the second inside lid 1220 are closed, of the folded portion 1210A. With this measure, impact that acts on the object TC in the direction (indicated by symbol R3 in FIG. 15A) that is parallel with its back surfaces 1210Ab and 1220Ab can be made weaker than in a case that part of a cut is formed in the wall 1210Aa.

As shown in FIGS. 14 and 15A, the mark M1 indicating the position of the portion TCa of the object TC housed in the packing box 100A is formed on a top surface 1210*a* of the first inside lid 1210.

Although in FIGS. 14 and 15A an arrow is employed as an example of the mark M1, there are no limitations on the specific manner of formation of the mark M1 except that it should indicate the position of the portion TCa of the object TC that cannot be seen.

With the above measure, when the first inside lid 1210 is closed, whether the object TC is being packed by the packing box 100A with correct orientation can be checked easily.

Instead of forming the mark M1 on the top surface 1210*a* of the first inside lid 1210, a mark M2 may be formed on a top surface 1220*a* of the second inside lid 1220 (see FIG. 15A). With the above measure, impact on the object TC can be made weaker than in a case that part of a cut is formed in the top surface 1210*a* of the first inside lid 1210, and a packing state of the object TC can be checked more easily than in a case that there is no means that allows checking of a position of the object TC relative to the first inside lid 1210.

Exemplary Embodiment 3

(1) Configuration of Packing Box

Figure 16:
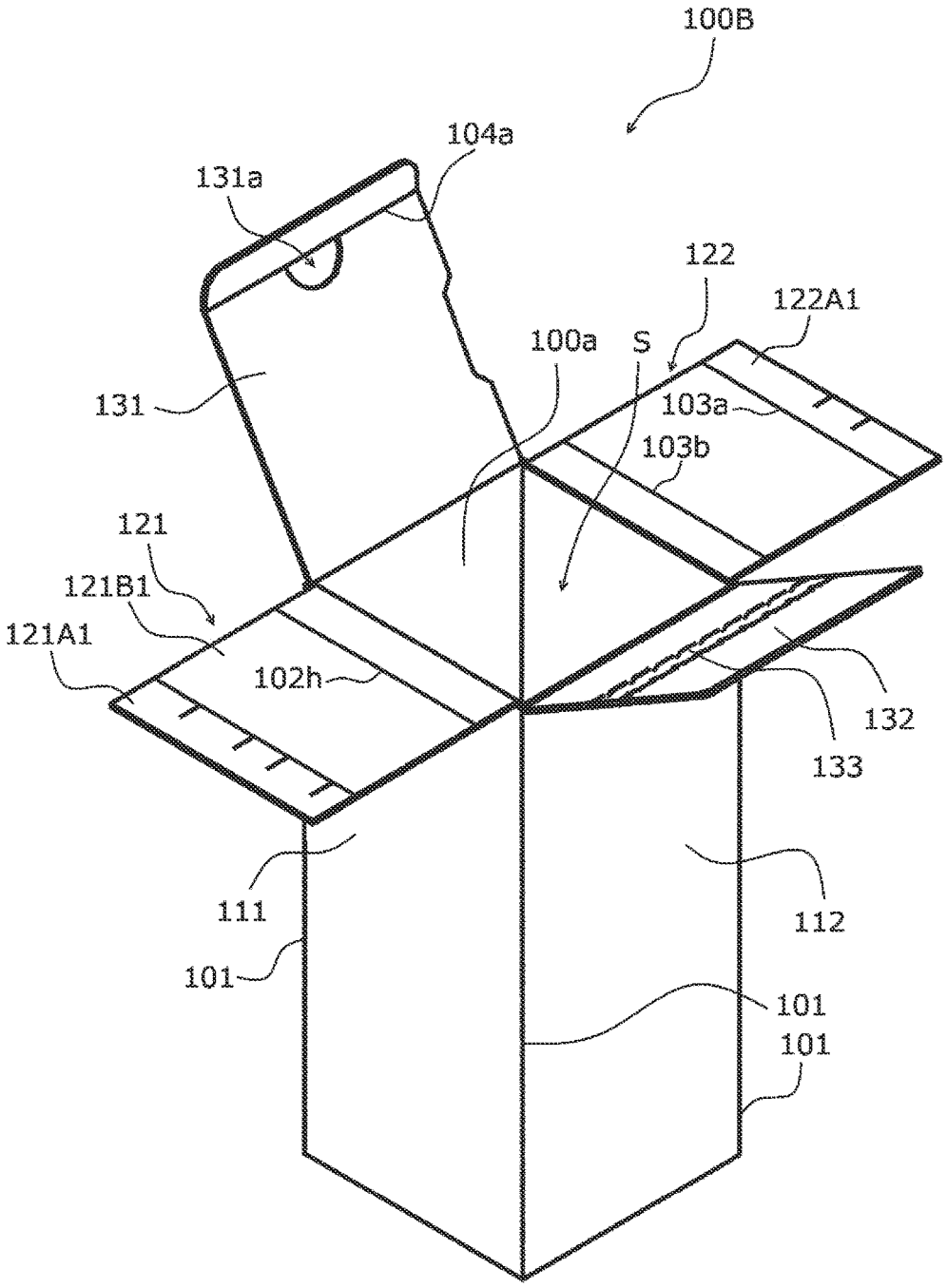
FIG. 16 is a perspective view of a packing box according to a third exemplary embodiment in a state that a first inside lid, a second inside lid, a first outside lid, and a second outside lid are opened.
Figure 17:
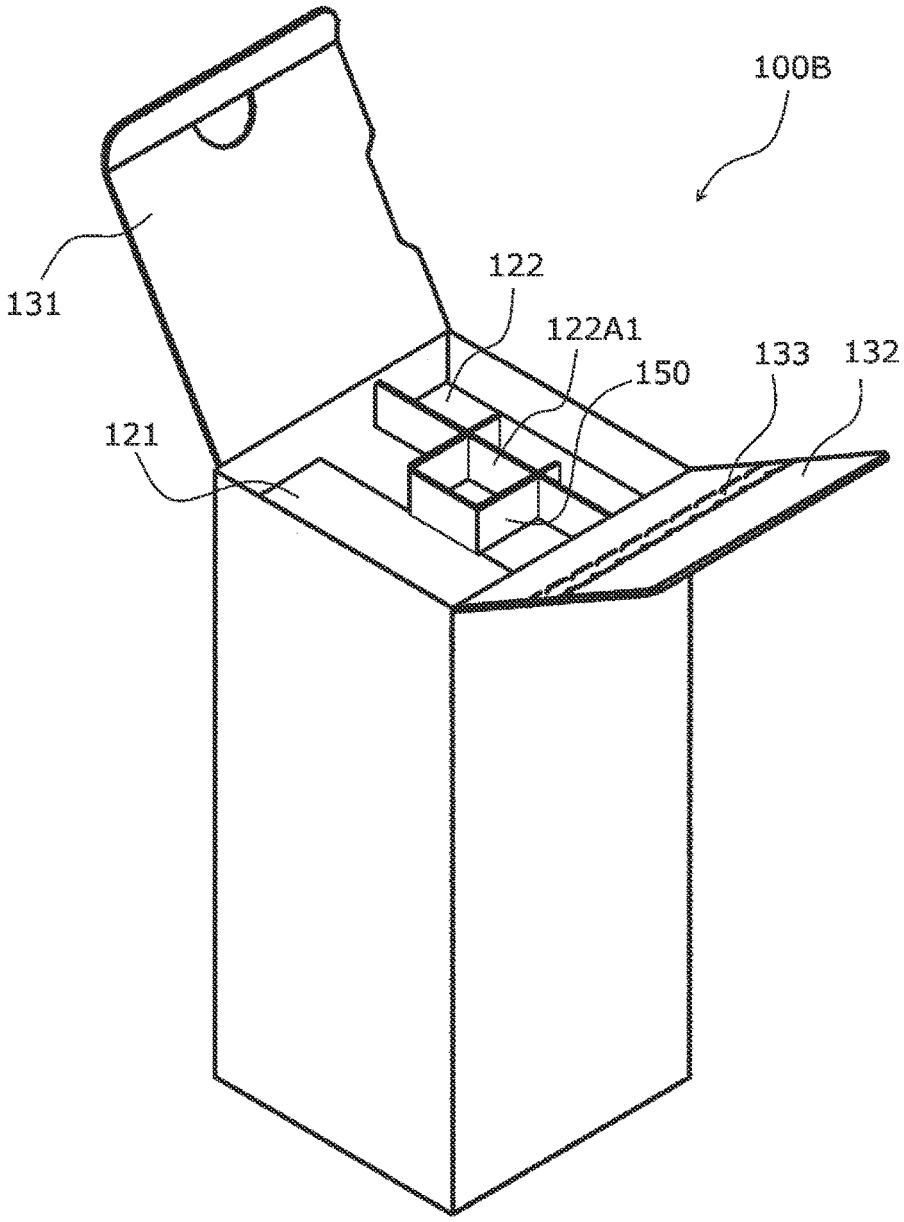
FIG. 17 is a perspective view of the packing box according to the third exemplary embodiment in a state that the first inside lid and the second inside lid are closed.
Figure 18:
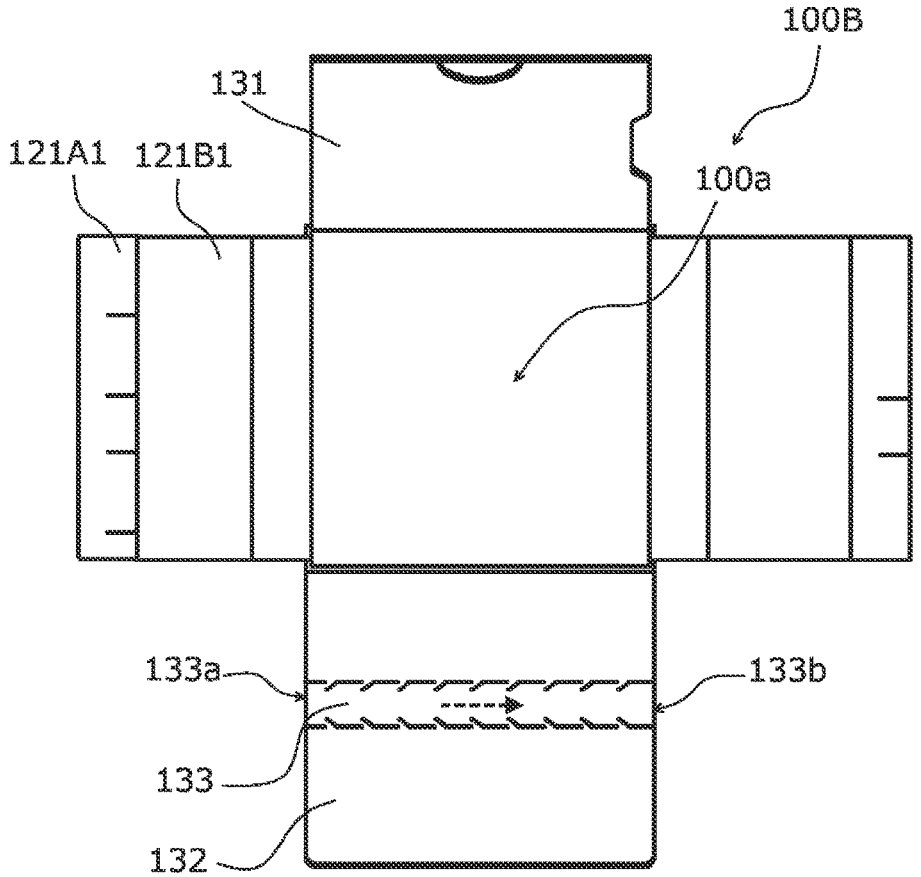
FIG. 18 is a plan view of the packing box according to the third exemplary embodiment in a state that the first inside lid, the second inside lid, the first outside lid, and the second outside lid are opened.
Figure 19:
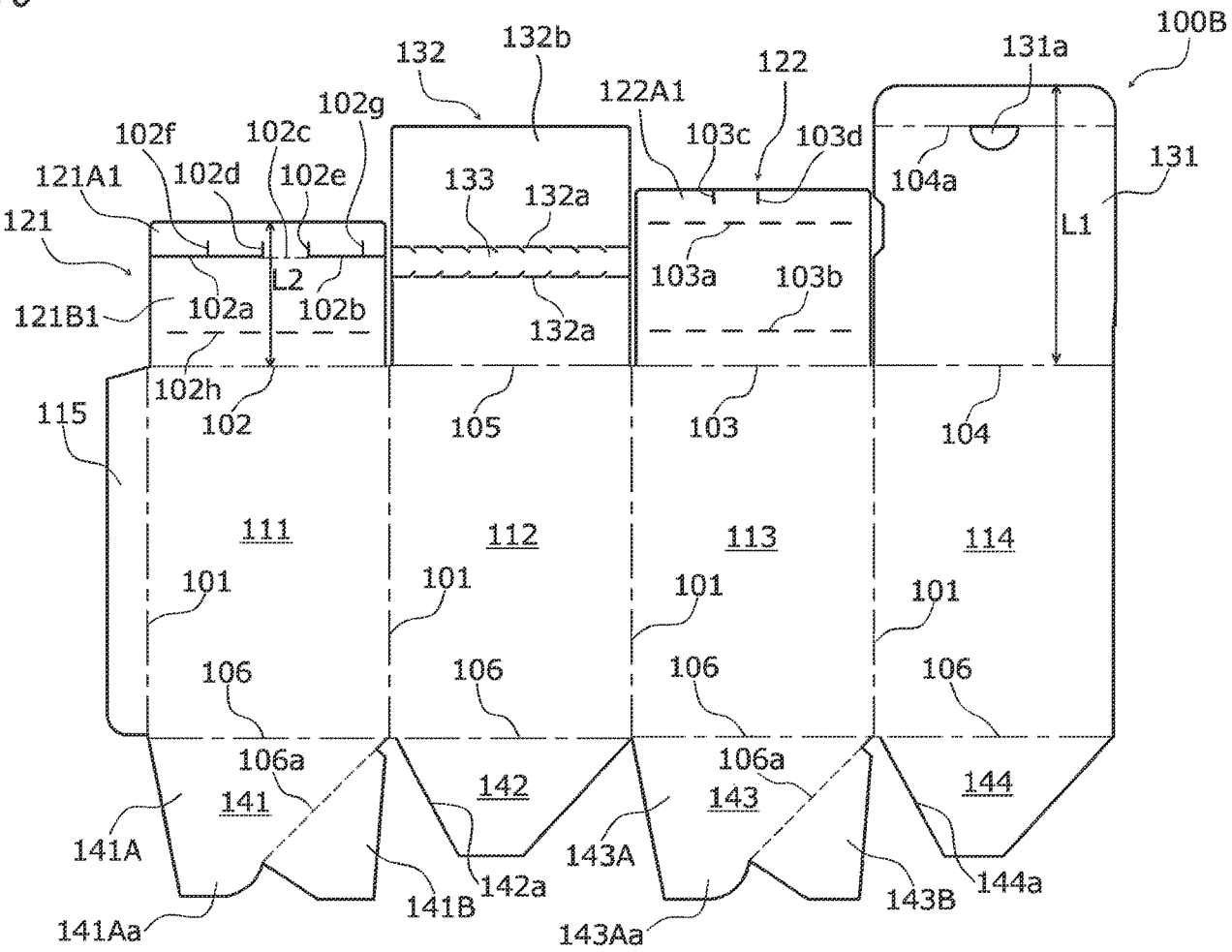
FIG. 19 is a development view of the packing box according to the third exemplary embodiment.

FIG. 16 is a perspective view of a packing box 100B according to a third exemplary embodiment in a state that a first inside lid 121, a second inside lid 122, a first outside lid 131, and a second outside lid 132 are opened. FIG. 17 is a perspective view of the packing box 100B in a state that the first inside lid 121 and the second inside lid 122 are closed. FIG. 18 is a plan view of the packing box 100B in a state that the first inside lid 121, the second inside lid 122, the first outside lid 131, and the second outside lid 132 are opened. FIG. 19 is a development view of the packing box 100B. The configuration of the packing box 100B will be described below with reference to the related drawings.

(1.1) Overall Configuration of Packing Box

As shown in FIGS. 16 and 17, the packing box 100B is shaped like a rectangular prism and has four side plates 111, 112, 113, and 114 that are continuous with each other at first folding lines 101. As shown in the development view of FIG. 19, to connect the side plates 111 and 114, the side plate 111 has a connection piece 115 that is connected to the side plate 111 at one of the first folding lines 101 (indicated by a chain line in FIG. 19).

A box-shaped body that has a rectangular prism-shaped inside space S enclosed by the four side plates 111, 112, 113, and 114 and an opening 100*a* through which to insert and take out an object TC to be packed (i.e., to be put in the inside space S) is formed by making mountain folds over the four respective first folding lines 101 and bonding the connection piece 115 to the side plate 114 that are set so that the first folding line 101 that bounds the connection piece 115 coincides with the edge of the side plate 114.

The side plate 111 is continuous with the first inside lid 121 at a second folding line 102 (indicated by a chain line in FIG. 19) which crosses (is perpendicular to) the first folding lines 101 that bound the sideplate 111. The first inside lid 121, which serves to close one side portion of the opening 100*a*, is formed with, near its tip edge, cuts 102*a* and 102*b* (indicated by solid lines in FIG. 19) which cross (are perpendicular to) extensions of the first bending lines 101 that bound the side plate 111 so that portions (separation portions) of a tip portion 121A1 can be separated from a first inside lid body 121B1. To reduce a material loss of the packing box 100B, it is preferable that the tip portion 121A1 be formed so that the length L1 of the first inside lid 121 in the direction perpendicular to the folding line 102 is shorter than or equal to the length L2 of the first outside lid 131 in the direction perpendicular to the folding line 104 (i.e., L1≥L2 (see FIG. 19)).

The tip portion 121A1 is valley-folded along a folding line 102*c* (indicated by a chain line in FIG. 19) that is formed between the cuts 102*a* and 102*b* by about 90°, and side portions of the tip portion 121A1 is separated from the first inside lid body 121B1 at the cuts 102*d* and 102*e* to form posts 150.

The first inside lid body 121B1 is valley-folded by about 90° along a folding line 102*h* (indicated by a broken line in FIG. 19) which is parallel with the second folding line 102, whereby a back surface 121*b* of the first inside lid 121 comes into contact with a top surface of the housed object TC.

The side plate 113 is continuous with the second inside lid 122 at a third folding line 103 (indicated by a chain line in FIG. 19) which crosses (is perpendicular to) the first folding lines 101 that bound the side plate 113 and extends in the same direction as the second folding line 102. The second inside lid 122, which serves to close the other side portion of the opening 100*a* (its one side portion is closed by the first inside lid 121), is formed with, near its tip edge, a folding line 103*a* (indicated by a broken line in FIG. 19) that crosses (is perpendicular to) extensions of the first folding lines 101 that bound the sideplate 113. A tip portion of the second inside lid 122 is valley-folded by about 90° to form an erected portion 122A1.

The erected portion 122A1 is formed with cuts 103*c* and 103*d* which reach its tip edge. The cuts 103*c* and 103*d* are fitted with the posts 150 past cuts 102*g* and 103*f*, respectively. As a result, the posts 150 are fixed bridging the first inside lid 121 and the second inside lid 122.

The second inside lid 122 is valley-folded by about 90° along a folding line 103*b* (indicated by a broken line in FIG. 19) which is parallel with the third folding line 103, whereby a back surface 122*b* comes into contact with a top surface of the housed object TC.

The side plate 114 is continuous with the first outside lid 131 at a fourth folding line 104 (indicated by a chain line in FIG. 19) which crosses (is perpendicular to) the first folding line 101 that bounds the side plate 114 and extends in the same direction as the second folding line 102. The first outside lid 131, which is a cover member for covering the first inside lid 121 and the second inside lid 122 in an openable manner, is formed with, near its tip edge, a folding line 104*a* (indicated by a chain line in FIG. 19) which crosses (is perpendicular to) an extension of the first folding line 101 that bounds the side plate 114. A tip portion of the first outside lid 131 is mountain-folded by about 90°.

The first outside lid 131 is formed with a hole 131*a* approximately at the center of the folding line 104*a* so that the first outside lid 131 can be opened by hooking a finger on the edge of the hole 131*a*.

The side plate 112 is continuous with the second outside lid 132 at a fifth folding line 105 (indicated by a chain line in FIG. 19) which crosses (is perpendicular to) the first folding lines 101 that bound the side plate 112 and extends approximately in the same direction as the second folding line 102. The second outside lid 132 is a cover member for covering the first outside lid 131. The second outside lid 132 is bonded to the closed first outside lid 131 with adhesive, for example, whereby the first inside lid 121, the second inside lid 122, and the first outside lid 131 are locked on each other and prevented from opening.

The second outside lid 132 is formed with, approximately at the center, two perforation lines 132*a* which are parallel with each other and define a separation piece 133 between them. To open the packing box 100B, a tip portion 133*a* of the separation piece 133 is held by fingers and pulled toward its base portion 133*b* (indicated by an arrow in FIG. 18), whereby the separation piece 133 is cut off from the second outside lid 132 along the perforation lines 132*a*.

As shown in FIG. 19, on the side opposite to the first inside lid 121, the second inside lid 122, the first outside lid 131, and the second outside lid 132, the side plates 111, 112, 113, and 114 are continuous with bottom plates 141, 142, 143, and 144 at sixth folding lines 106 (indicated by chain lines in FIG. 19), respectively.

The bottom plate 141 is composed of a first bottom plate 141A and a second bottom plate 141B which become narrower as the position goes away from the corresponding sixth folding line 106. The tip edge of the bottom plate 141 is formed with a triangular cut approximately at the center, and the bottom plate 141 is formed with a folding line 106*a* (indicated by a broken line in FIG. 19) which extends from the inner apex of the triangular cut to one end of the sixth folding line 106 of the bottom plate 141. On the other hand, the bottom plate 142 which is adjacent to the bottom plate 141 in a developed state is shaped so as to become narrower while being kept approximately symmetrical with respect to its center line that is perpendicular to the corresponding sixth folding line 106 as the position goes away from the corresponding sixth folding line 106.

The bottom plates 141 and 142 having the above-described shapes are bonded to each other so that the folding line 106*a* of the bottom plate 141 coincides with one side 142*a* of the bottom plate 142 when the combination of the side plates 111 and 112 is folded along the first folding line 101 bounding them. A tip portion of the first bottom plate 141A becomes an insertion piece 141Aa.

The bottom plates 143 and 144 are shaped in the same manners as the bottom plates 141 and 142, respectively. The bottom plates 143 and 144 are bonded to each other so that a folding line 106*a* (indicated by a broken line in FIG. 19) of the bottom plate 143 coincides with one side 144*a* of the bottom plate 144 when the combination of the side plates 113 and 114 is folded along the first folding line 101 bounding them. A tip portion of a first bottom plate 143A becomes an insertion piece 143Aa.

The bottom plates 141 and 143 are valley-folded along the respective folding lines 106*a*, the insertion piece 141Aa is inserted between the bonding portions of the bottom plates 143 and 144, and the insertion piece 143Aa is inserted between the bonding portions of the bottom plates 141 and 142. As a result, a bottom portion is formed that does not open easily.

(2) Inside Lids

Figure 20:
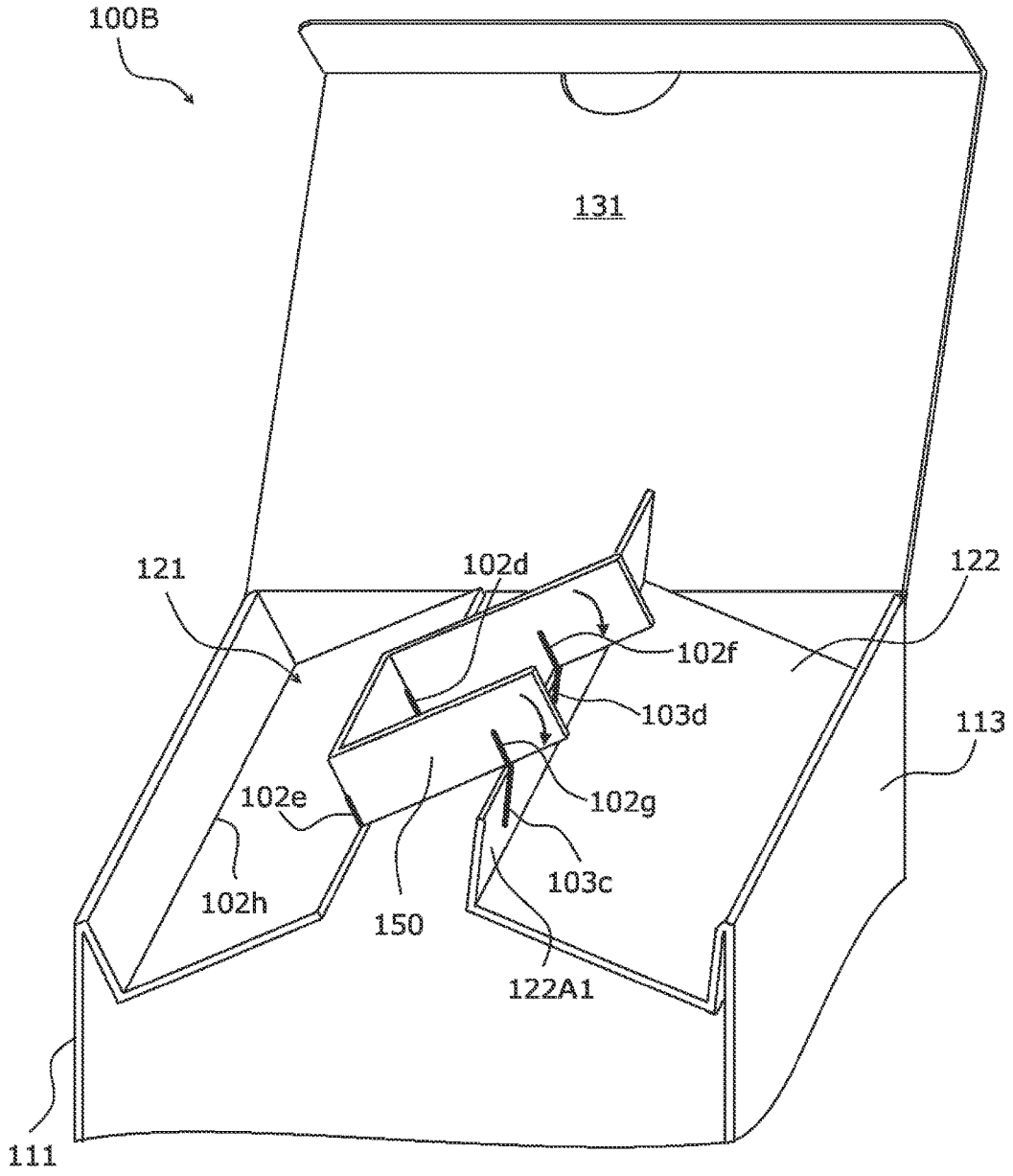
FIG. 20 is a perspective view showing part of the packing box according to the third exemplary embodiment in a state that posts bridge the first inside lid and the second inside lid, with one side plate omitted.
Figure 21A:
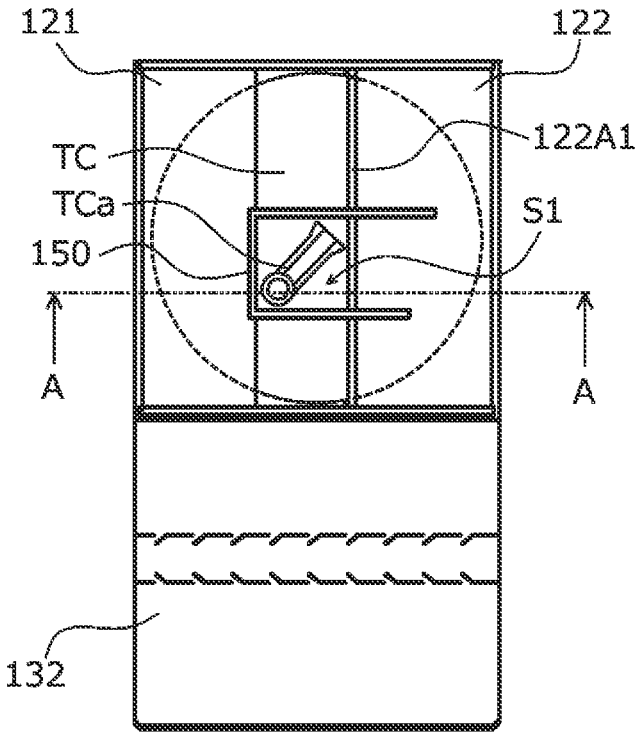
FIG. 21A is a schematic plan view showing the packing box according to the third exemplary embodiment in a state that an object is housed therein and the first inside lid and the second inside lid are closed, with the first outside lid omitted.
Figure 21B:
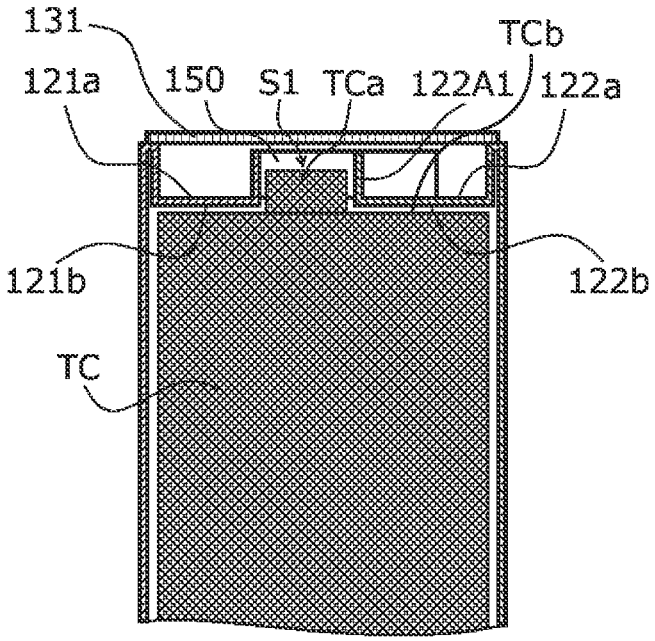
FIG. 21B is a schematic sectional view taken along line A-A in FIG. 21A.

FIG. 20 is a perspective view showing part of the packing box 100B in a state that the posts 150 bridge the first inside lid 121 and the second inside lid 122, with the side plate 112 omitted. FIG. 21A is a schematic plan view showing the packing box 100B in a state that the object TC is housed therein and the first inside lid 121 and the second inside lid 122 are closed, with the first outside lid 131 omitted, and FIG. 21B is a schematic sectional view taken along line A-A in FIG. 21A.

The structures of the first inside lid 121 and the second inside lid 122 of the packing box 100B according to the exemplary embodiment will be described below with reference to the related drawings.

In the packing box 100B, the object TC that is put in the inside space S is fixed by closing the opening 100*a* by the first inside lid 121 and the second inside lid 122.

In the first inside lid 121, the posts 150 are separated from the tip portion 121A1 at the cuts 102*a* and 102*b* while the central portion of the tip portion 121A1 is mountain-folded along the folding line 102*c*, and the posts 150 are folded by about 90° along the cuts 102*d* and 102*e*.

The tip portion of the second inside lid 122 is valley-folded by about 90° along the folding line 103*a* to form the erected portion 122A1. The erected portion 122A1 is formed with the cuts 103*c* and 103*d* which reach its tip edge. The cuts 103*c* and 103*d* are fitted with the posts 150 past cuts 102*g* and 103*f*, respectively (indicated by arrows in FIG. 20). As a result, as shown in FIGS. 17 and 21A, the posts 150 bridge the first inside lid 121 and the second inside lid 122 which closes the opening 100*a*. This measure can make the probability of loss of the posts 150 lower than in a case that the posts 150 are separate components.

The posts 150 are disposed at such positions as to be fitted with a portion TCa of the object TC and, as shown in FIG. 21A, form an inside space S1 that is shaped like a rectangle in a plan view. The posts 150 are fixed in a state that the portion TCa of the object TC is set in the space S1 and a projection of the object TC is covered with and surrounded by the frame structure including the posts 150. With this measure, the projection of the object TC can be prevented from being damaged.

As shown in FIG. 21B, the posts 150 are disposed on top surfaces 121*a* and 122*a* of the first inside lid 121 and the second inside lid 122 approximately perpendicularly to the latter and support the first outside lid 131. Back surfaces 121*b* and 122*b* of the first inside lid 121 and the second inside lid 122 are in contact with a surface TCb of the object TC that faces the opening 100*a* and thereby fix the object TC.

This makes it unnecessary to use a pad that conforms to the external shape of the object TC and the internal shape of a packing box and to press the pad by inside lids. This also makes it possible to reduce impact that acts on the object TC during transport.

Where the packing box 100B is made of known corrugated cardboard in which front and back liners and a corrugated core sheet are laminated together using adhesive, for example, it is preferable that in a development view of the packing box 100B the corrugated cardboard be oriented so that the extension direction of its flutes coincides with the height direction of the posts 150. This makes it possible to increase the strength of the posts 150 which is sandwiched between the combination of the first inside lid 121 and the second inside lid 122 and the combination of the first outside lid 131 and the second outside lid 132.

(3) Outside Lids

In the packing box 100B, in a state that the object TC that is put in the inside space S is fixed by the posts 150 by closing the opening 100*a* by the first inside lid 121 and the second inside lid 122, the first inside lid 121 and the second inside lid 122 are covered with the first outside lid 131 with the posts 150 sandwiched between them by closing the first outside lid 131.

Then the second outside lid 132 is folded and a bonding portion 132*b* (see FIG. 19), located on the tip side of the separation piece 133, of the second outside lid 132 is bonded, with adhesive, for example, to the surface of the first outside lid 131 which was closed earlier, whereby the first inside lid 121, the second inside lid 122, and the first outside lid 131 are locked and prevented from opening.

To take out the object TC by opening the packing box 100B, the separation piece 133 is cut off from the second outside lid 132 to establish a state that the first outside lid 131 can be opened.

Modification

Figure 22:
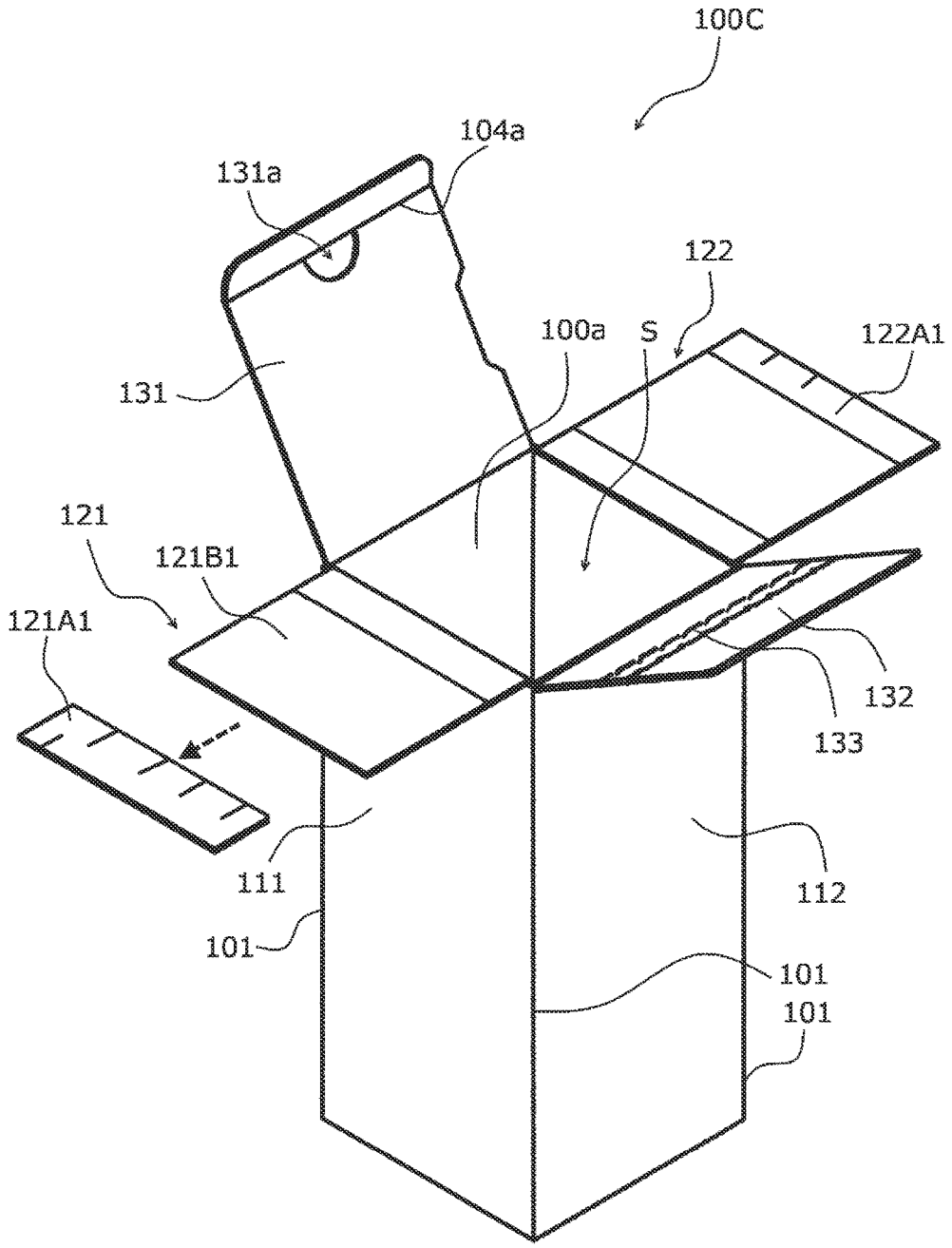
FIG. 22 is a perspective view of a packing box according to a modification of the third exemplary embodiment in a state that the first inside lid, the second inside lid, the first outside lid, and the second outside lid are opened.
Figure 23:
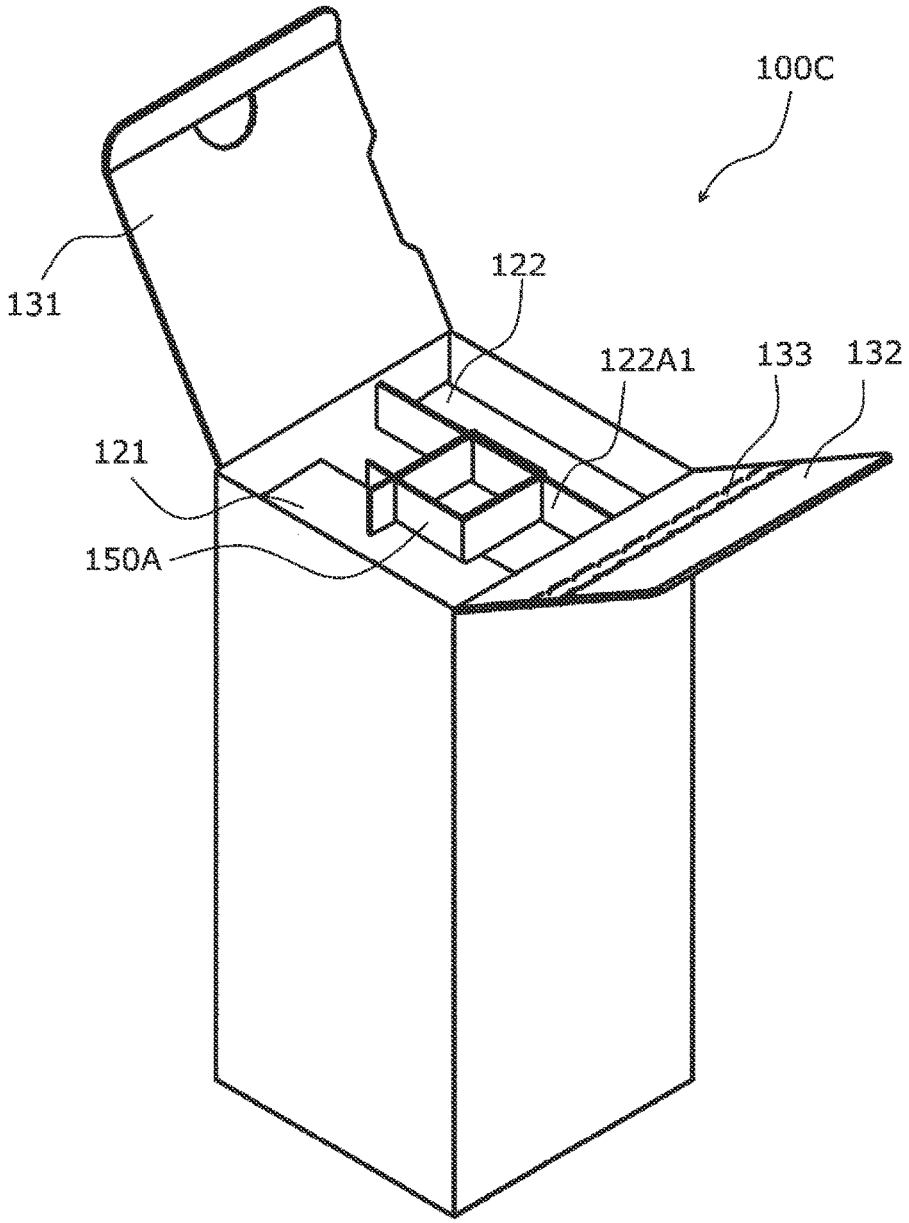
FIG. 23 is a perspective view of the packing box according to the modification in a state that the first inside lid and the second inside lid are closed.
Figure 24:
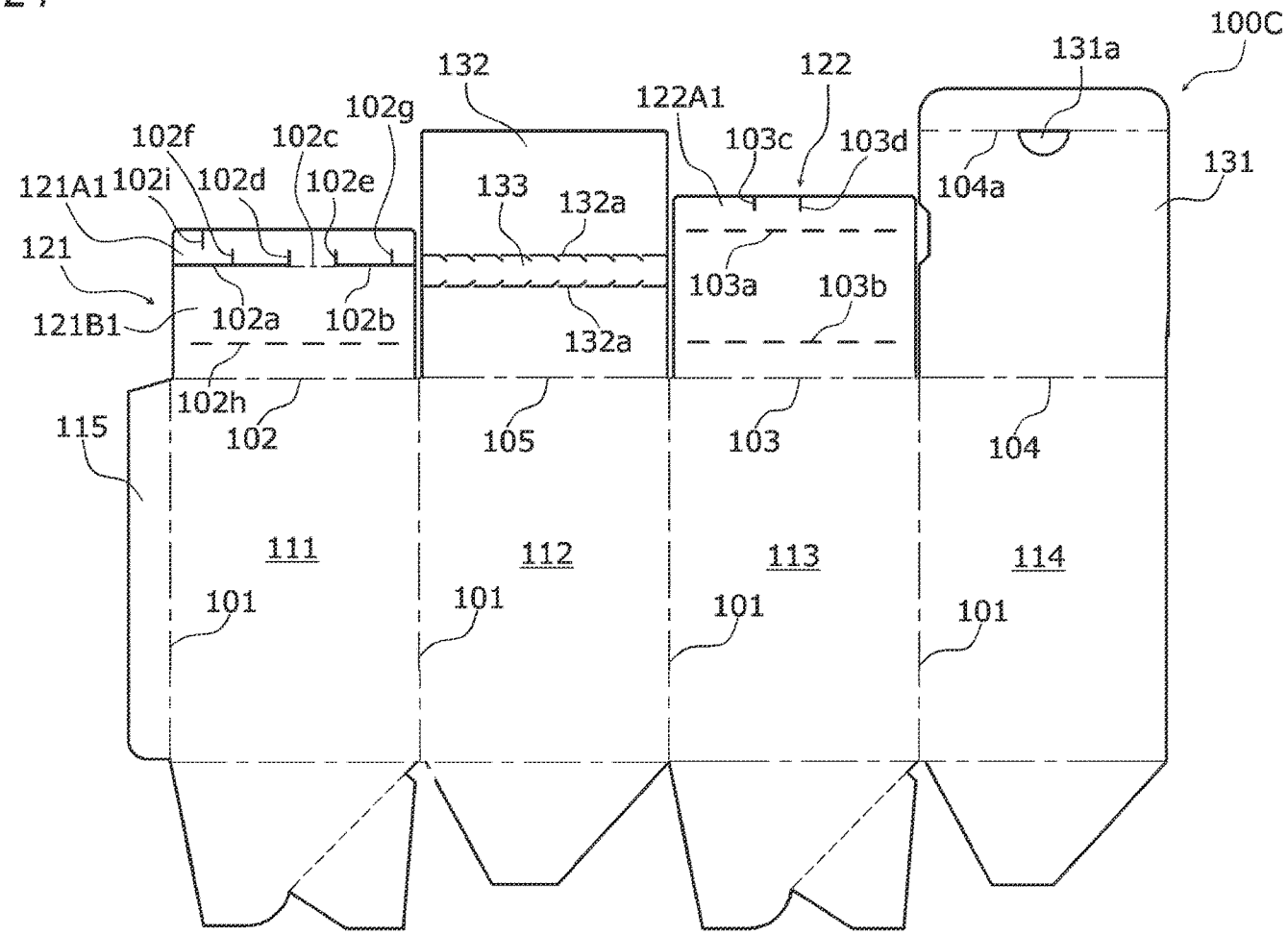
FIG. 24 is a development view of the packing box according to the modification.
Figure 25:
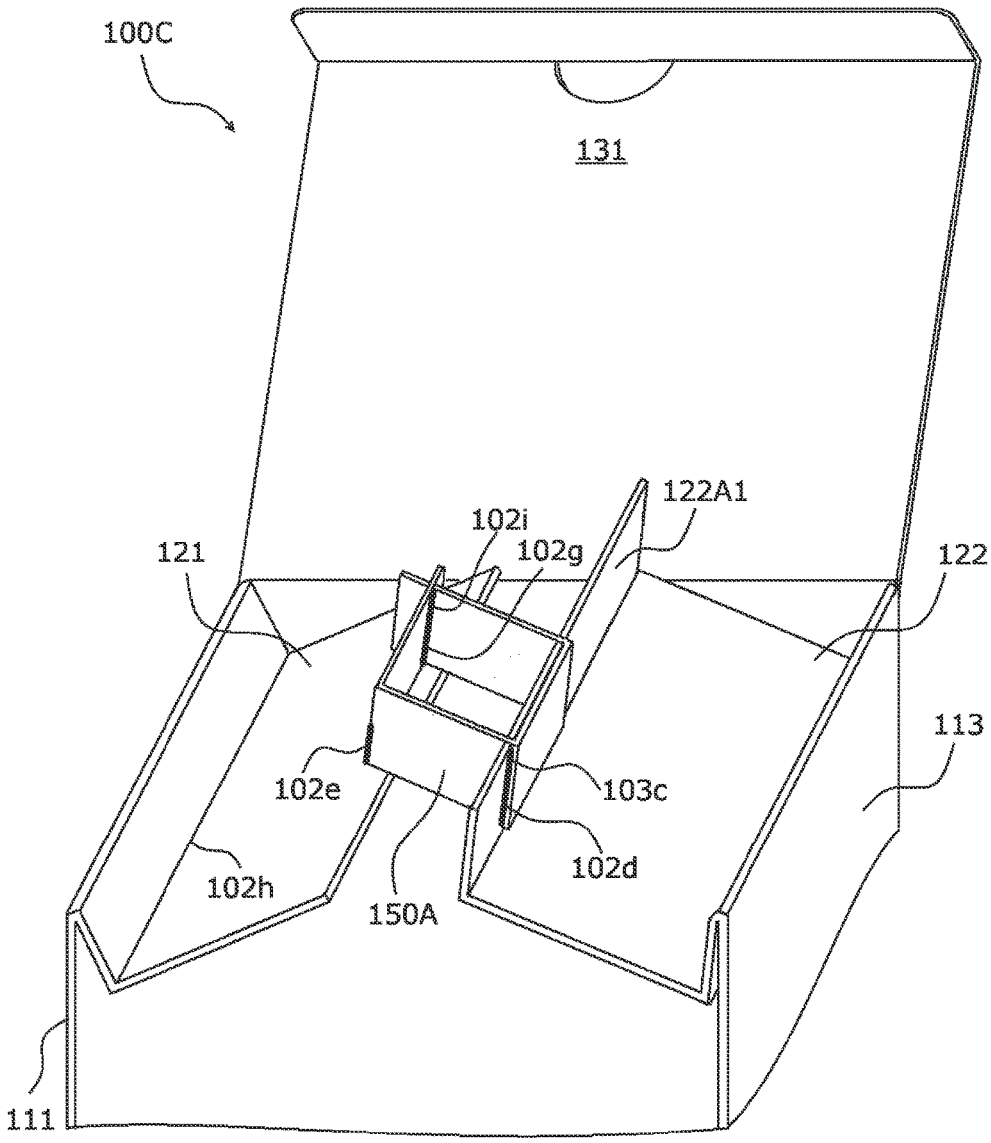
FIG. 25 is a perspective view showing part of the packing box according to the modification in a state that a post bridges the first inside lid and the second inside lid, with one side plate omitted.
Figure 26A:
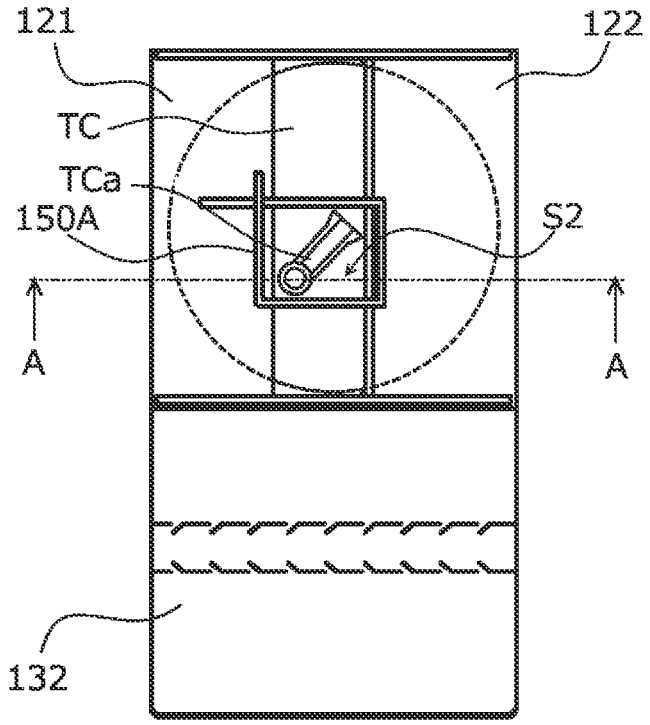
FIG. 26A is a schematic plan view showing the packing box according to the modification in a state that the object is housed therein and the first inside lid and the second inside lid are closed, with the first outside lid omitted.
Figure 26B:
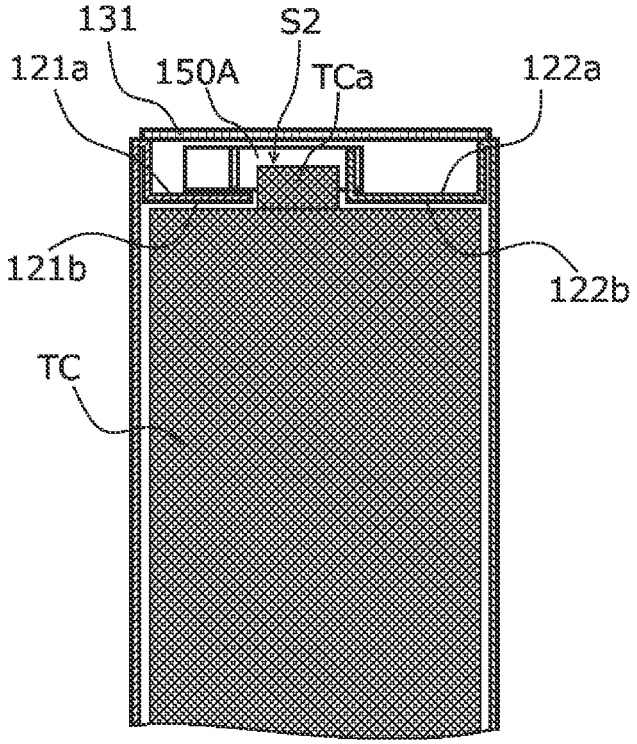
FIG. 26B is a schematic sectional view taken along line A-A in FIG. 26A.

FIG. 22 is a perspective view of a packing box 100C according to a modification of the third exemplary embodiment in a state that the first inside lid 121, the second inside lid 122, the first outside lid 131, and the second outside lid 132 are opened. FIG. 23 is a perspective view of the packing box 100C in a state that the first inside lid 121 and the second inside lid 122 are closed. FIG. 24 is a development view of the packing box 100C. FIG. 25 is a perspective view showing part of the packing box 100C in a state that posts 150A bridge the first inside lid 121 and the second inside lid 122, with the side plate 112 omitted. FIG. 26A is a schematic plan view showing the packing box 100C in a state that the object TC is housed therein and the first inside lid 121 and the second inside lid 122 are closed, with the first outside lid 131 omitted, and FIG. 26B is a schematic sectional view taken along line A-A in FIG. 26A.

In the packing box 100C according to the modification, a post 150A is formed as a separate component by cutting off the tip portion 121A1 is from the first inside lid 121 (indicated by an arrow in FIG. 22) and folding the cut-off tip portion 121A1 by about 90° along each of the cuts 102*d*, 102*e*, and 102*f*.

As shown in FIG. 23, the post 150A thus formed is fitted with the erected portion 122A1 of the second inside lid 122 and bridges the first inside lid 121 and the second inside lid 122 that closes the opening 100*a*. This measure makes it possible to not only prevent loss of the post 150A in packing work but also increase the efficiency of work of forming the post 150A.

More specifically, the tip portion 121A1 is cut off from the first inside lid 121 along a cutting line 102*c* shown in the development view of FIG. 24 and the cut-off tip portion 121A1 is folded by about 90° along each of the cuts 102*d*, 102*e*, and 102*f*. The end portions of the thus-folded tip portion 121A1 are fitted into/with each other along the cuts 102*g* and 102*i*, whereby a box-shaped post 150A is formed that has a space S2 inside that is rectangular in a plan view.

As shown in FIG. 25, the post 150A which is a separate component and the erected portion 122A1 of the second inside lid 122 are fitted into/with each other along the pair of cuts 102*d* and 103*c* and the pair of cuts 102*f* and 103*d* (the cuts 103*c* and 103*d* are formed in the erected portion 122A1), whereby the post 150A bridges the first inside lid 121 and the second inside lid 122 that close the opening 100*a*.

As shown in FIG. 26A, the object TC is fixed in a state that its portion TCa is set in a space S2 and thereby prevented from rotating. The post 150A is disposed on top surfaces 121*a* and 122*a* of the first inside lid 121 and the second inside lid 122 approximately perpendicularly to the latter and support the first outside lid 131.

This makes it unnecessary to use a pad that conforms to the external shape of the object TC and the internal shape of a packing box and to press the pad by inside lids. This also makes it possible to reduce impact that acts on the object TC during transport.

Exemplary Embodiment 4

Figure 27:
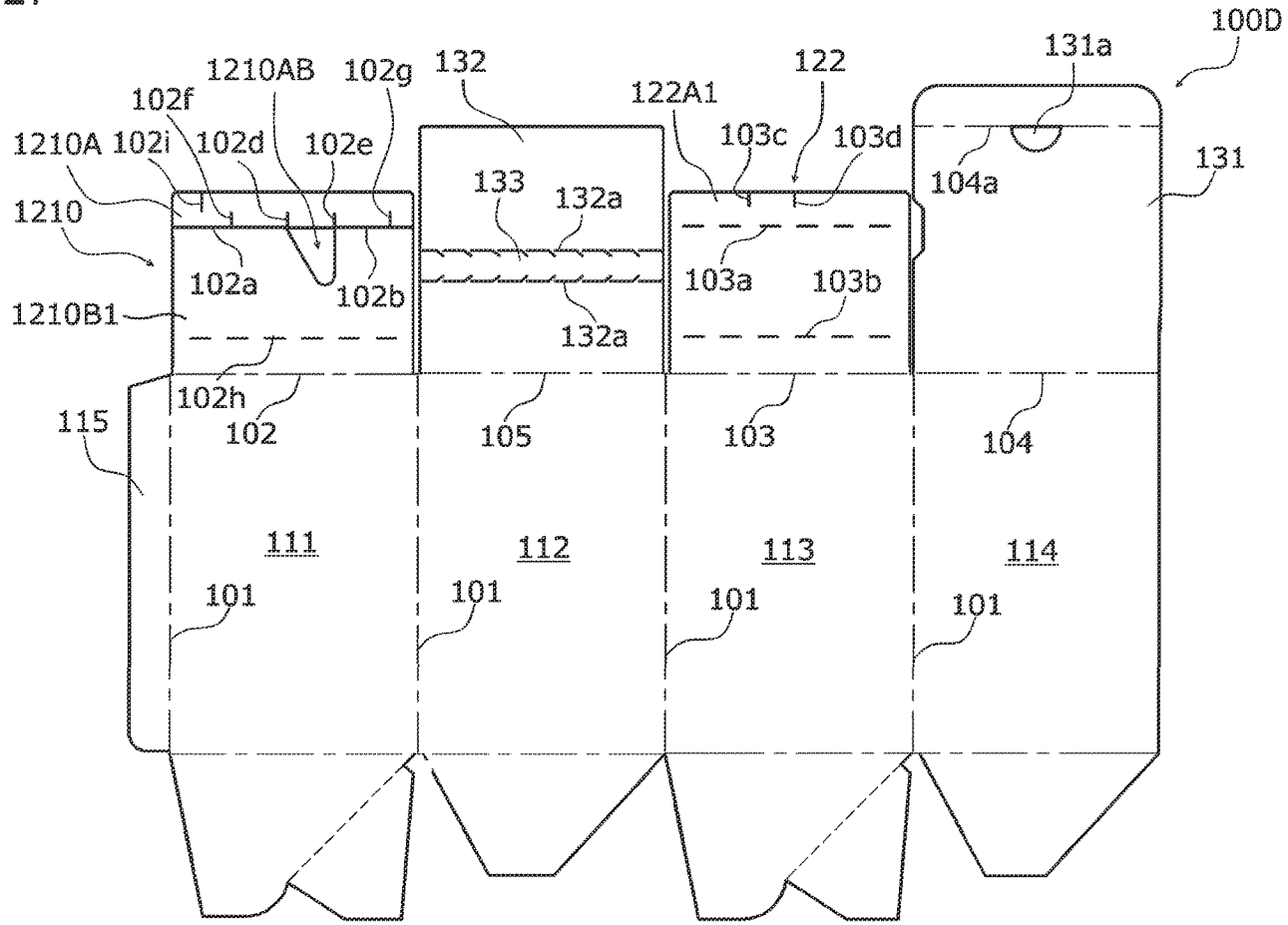
FIG. 27 is a development view of a packing box according to a fourth exemplary embodiment.
Figure 28:
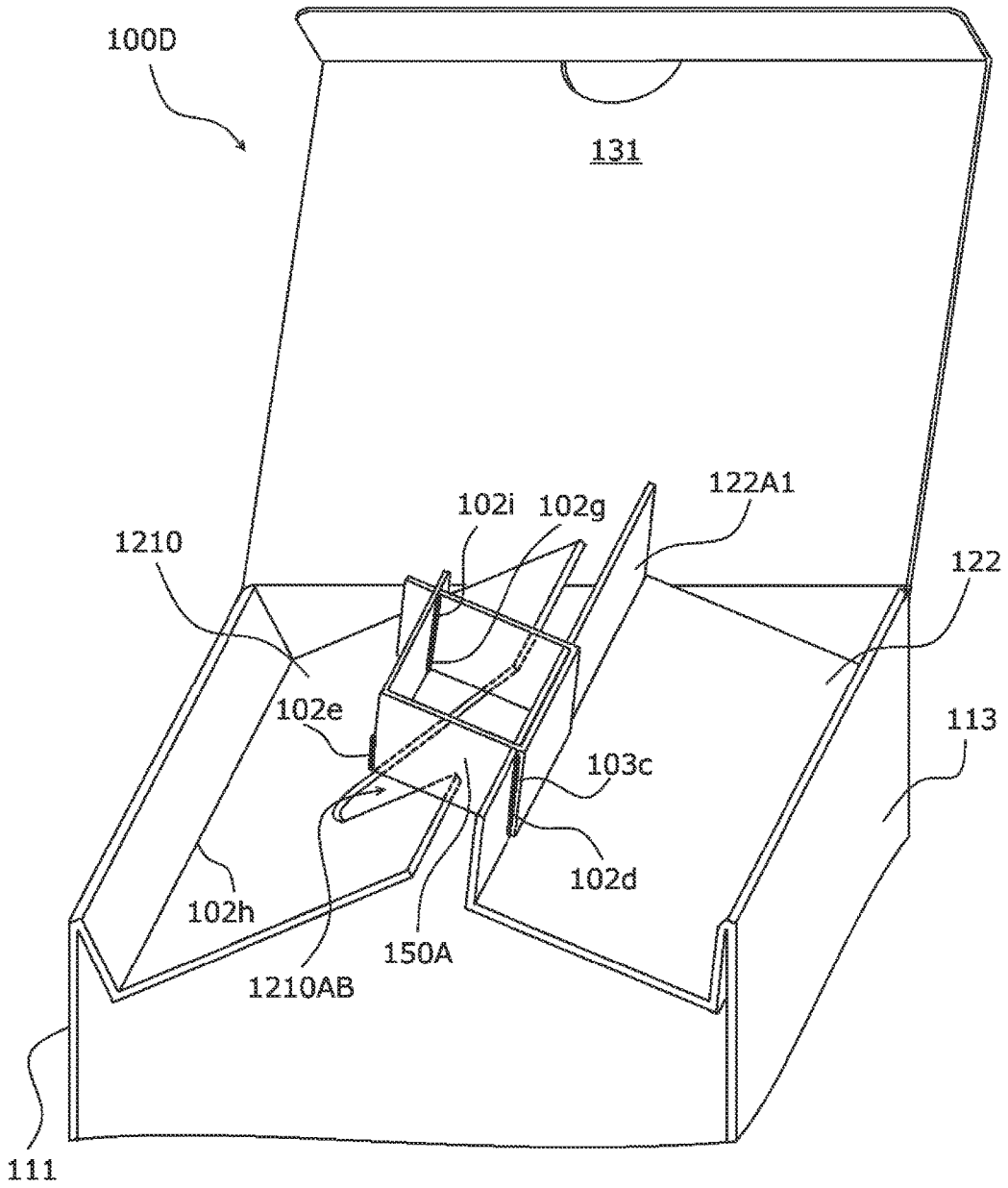
FIG. 28 is a perspective view showing the packing box according to the fourth exemplary embodiment with the side plate 112 omitted.
Figure 29A:
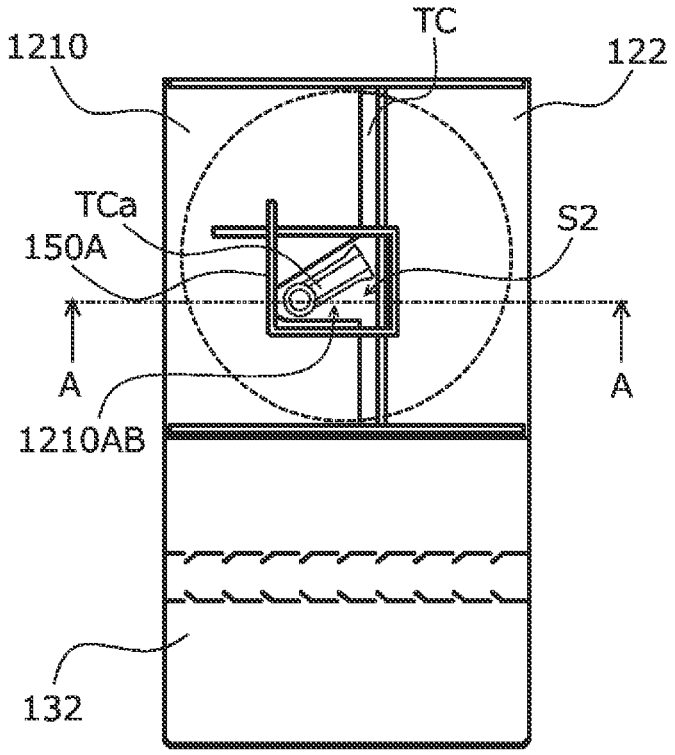
FIG. 29A is a schematic plan view of the packing box according to the fourth exemplary embodiment in a state that the object is housed therein and a first inside lid and the second inside lid are closed.
Figure 29B:
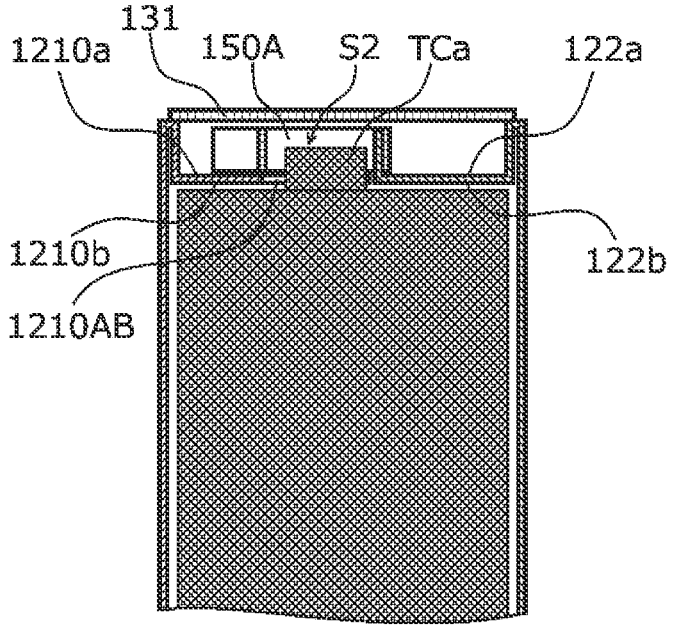
FIG. 29B is a schematic sectional view taken along line A-A in FIG. 29A.

FIG. 27 is a development view of a packing box 100D according to a fourth exemplary embodiment. FIG. 28 is a perspective view showing the packing box 100D with the side plate 112 omitted. FIG. 29A is a schematic plan view of the packing box 100D in a state that the object TC is housed therein and a first inside lid 1210 and the second inside lid 122 are closed, and FIG. 29B is a schematic sectional view taken along line A-A in FIG. 29A.

The packing box 100D will be described below with reference to the related drawings. Constituent elements having the same ones in the packing box 100C according to the modification of the third exemplary embodiment will be given the same reference numerals as the latter, and detailed descriptions therefor will be omitted.

The packing box 100D according to the fourth exemplary embodiment is different from the packing box 100C according to the modification of the third exemplary embodiment in that a cut portion 1210AB is formed so as to be suitable for the portion TCa of the object TC.

As shown in FIG. 27, the side plate 111 is continuous with the first inside lid 1210 at the second folding line 102 (indicated by a chain line in FIG. 27) which crosses (is perpendicular to) the first folding lines 101 that bound the side plate 111. The first inside lid 1210, which serves to close one side portion of the opening 100*a*, is formed with, near its tip edge, the cuts 102*a* and 102*b* (indicated by solid lines in FIG. 27) which cross (are perpendicular to) extensions, of the first folding lines 101 that bound the side plate 111, whereby a tip portion 1210A can be cut off from a first inside lid body 1210B1.

The cut-off tip portion 1210A is folded by about 90° along each of the cuts 102*d*, 102*e*, and 102*f*. The end portions of the thus-folded tip portion 1210A are fitted into/with each other along the cuts 102*g* and 102*i*, whereby the box-shaped post 150A is formed that has the space S2 inside that is rectangular in a plan view.

As shown in FIG. 28, the thus-formed post 150A and the erected portion 122A1 of the second inside lid 122 are fitted into/with each other along the pair of cuts 102*d* and 103*c* and the pair of cuts 102*f* and 103*d* (the cuts 103*c* and 103*d* are formed in the erected portion 122A1), whereby the post 150A bridges the first inside lid 1210 and the second inside lid 122 that close the opening 100*a*.

As shown in FIG. 29B, a base portion of the first inside lid 1210 is valley-folded by about 90° along a folding line 102*h* (indicated by a broken line in FIG. 27) which is parallel with the second folding line 102, whereby a back surface 1210*b* of the first inside lid 1210 comes into contact with a top surface of the housed object TC and the cut portion 1210AB is fitted with the portion TCa of the object TC.

A base portion of the second inside lid 122 is valley-folded by about 90° along a folding line 103*b* (indicated by a broken line in FIG. 27) which is parallel with the third folding line 103, whereby a back surface 122*b* of the second inside lid 122 comes into contact with a top surface of the housed object TC.

According to the packing box 100D according to the exemplary embodiment, since the post 150A is fitted with the portion TCa of the object TC and fixes the projection of the object TC by covering and surrounding it and the cut portion 1210AB is fitted with the portion TCa of the object TC, whereby the object TC can be fixed reliably and impact on the object TC can be reduced.

Although the specific examples have been described as the exemplary embodiments of the invention, the technical scope of the invention is not limited to the exemplary embodiments and various modifications are possible without departing from the spirit and scope of the invention.

For example, although the packing box according to each exemplary embodiment is shaped like a rectangular prism, the invention can also be applied to packing boxes that are shaped like polygonal prisms having five or more sides in cross section or other various shapes having a space for accommodating an object to be packed. Furthermore, there are no limitations on the size of an object to be packed by the packing box according to the invention; the object to be packed may be any of a variety of objects that are packed by existing packing boxes.

What is claimed is:

1. A packing box comprising inside lids, at least part of an opening of the packing box through which to insert and take out an object to be packed being capable of being closed by the inside lids, the inside lids opposed to each other in a plane, wherein:

the inside lids have a cut portion including a cut that is shaped so as to be suitable for the external shape of a portion of the object and folded portions formed by folding the respective inside lids, and, when the inside lids are closed, the cut is fitted with the portion of the object housed in the packing box to fix the object in a state that walls, opposed to each other, of the respective folded portions are in contact with each other, the cut portion is formed in one of the folded portions so as to be suitable for the position of the portion of the object, and the cut is formed in a wall excluding the wall that comes into contact with the wall of the other folded portion when the inside lids are closed.

2. The packing box according to claim 1, wherein:

each of the folded portions is formed by folding the corresponding inside lid plural times; and when the inside lids are closed, a part of the each of the folded portions, which is formed by folding the corresponding inside lid plural times, is in contact with a surface, opposed to the opening, of the object housed in the packing box to fix the object.

3. The packing box according to claim 1, wherein:

the inside lids are a first inside lid that is formed with the cut and a second inside lid that is not formed with the cut; and the first inside lid has a mark that indicates the position of the portion of the object housed in the packing box in closing the first inside lid in a state that the second lid is open.

4. The packing box according to claim 1, wherein:

the cut portion is formed in one of the folded portions; and the inside lids have a mark that indicates the position of the portion of the object housed in the packing box in closing one of the inside lids in a state that the other inside lid is open.

5. The packing box according to claim 1, further comprising an outside lid that covers the inside lids, wherein:

each of the folded portions is formed by folding, plural times, to the same side, the corresponding inside lid whose length in a direction in which to extend toward a free edge thereof is within the length of the outside lid in a direction in which to extend toward a free edge thereof.

6. The packing box according to claim 5, wherein the outside lid is bounded by a shorter side of the opening.

7. The packing box according to claim 5, wherein the outside lid is bounded by a longer side of the opening.

8. The packing box according to claim 1, wherein the folded portions are arranged in a direction orthogonal to a direction in which flutes of corrugated cardboard extend, and the folded portions come into contact with inner surfaces, adjoining the opening, of the packing box when the inside lids are closed.

9. The packing box according to claim 1, wherein the cut portion fixes the object so as to prevent rotation of the object in a state that the inside lids are closed.

10. A packing box comprising inside lids, an opening of the packing box through which to insert and take out an object to be packed being capable of being closed by the inside lids, the inside lids opposed to each other in a plane, the packing box further comprising:

an outside lid that covers the inside lids; and a post that is disposed approximately perpendicularly to the inside lids between the outside lid and the inside lids and supports the outside lid, wherein the post is made of a material having a corrugate cardboard structure in such a manner that flutes of the material extend in a direction of height with respect to top surfaces of the inside lids.

11. The packing box according to claim 10, wherein the post is formed by separating a portion of a separation portion that is part of one of the inside lids and is defined by plural cuts and a folding line from the one inside lid, and folding the separation portion along the cuts and the folding line.

12. The packing box according to claim 11, wherein the post is formed by folding the separation portion along the cuts and the folding line so as to be able to surround a portion of the object, and is disposed at such a position as to be fitted with the portion of the object.

13. The packing box according to claim 11, wherein the separation portion is part of one of the inside lids whose length in a direction in which to extend toward a free edge thereof is within the length of the outside lid in a direction in which to extend toward a free edge thereof.

14. The packing box according to claim 10, wherein the post is formed by cutting off a portion of a separation portion that is part of one of the inside lids and is defined by plural cuts and a cutting line from the one inside lid along the cutting line, and folding the separation portion along the cuts.

15. The packing box according to claim 10, wherein the inside lids being closed are in contact with a portion of the object.

16. The packing box according to claim 15, wherein one of the inside lids has a cut that is shaped so as to be suitable for the external shape of a portion of the object, and, when the inside lids are closed, the cut is fitted with the portion of the object housed in the packing box to fix the object.

* * * * *